US011085140B2

(12) United States Patent
Uchiyama et al.

(10) Patent No.: US 11,085,140 B2
(45) Date of Patent: Aug. 10, 2021

(54) WASHING MACHINE

(71) Applicant: Toshiba Lifestyle Products & Services Corporation, Kawasaki (JP)

(72) Inventors: Tomonori Uchiyama, Kawasaki (JP); Hironori Sasaki, Kawasaki (JP)

(73) Assignee: Toshiba Lifestyle Products & Services Corporation, Kawasaki (JP)

( * ) Notice: Subject to any disclaimer, the term of this patent is extended or adjusted under 35 U.S.C. 154(b) by 0 days.

(21) Appl. No.: 16/267,414

(22) Filed: Feb. 5, 2019

(65) Prior Publication Data

US 2019/0169778 A1 Jun. 6, 2019

Related U.S. Application Data

(63) Continuation of application No. PCT/JP2017/027873, filed on Aug. 1, 2017.

(30) Foreign Application Priority Data

Aug. 18, 2016 (JP) ..... JP2016-160539

(51) Int. Cl.
*D06F 39/08* (2006.01)
*D06F 37/12* (2006.01)
(Continued)

(52) U.S. Cl.
CPC ..... *D06F 37/12* (2013.01); *B01F 3/04* (2013.01); *B01F 5/06* (2013.01); *D06F 33/00* (2013.01);
(Continued)

(58) Field of Classification Search
CPC .... D06F 18/00; D06F 33/00; D06F 33/30–76; D06F 34/00–34;
(Continued)

(56) References Cited

U.S. PATENT DOCUMENTS

2008/0099051 A1 5/2008 Kim et al.
2010/0122421 A1 5/2010 Sa
(Continued)

FOREIGN PATENT DOCUMENTS

CN 2832872 Y 11/2006
CN 101492873 A 7/2009
(Continued)

OTHER PUBLICATIONS

Machine Translation of Abe, JP 2009-178195 A, Aug. 2009. (Year: 2009).*
(Continued)

*Primary Examiner* — David G Cormier
(74) *Attorney, Agent, or Firm* — Oblon, McClelland, Maier & Neustadt, L.L.P.

(57) ABSTRACT

A washing machine (10) including a wash tub configured by a water tub (13) and a rotary tub (14); a connecting port (21) connected to a water source; a water feeding case (40) connected to the connecting port (21) to receive water from the water source and containing a detergent storing part (42) in which a detergent is stored; a first water feeding port (41) configured to feed water flown into the water feeding case (40) into the wash tub; a minute bubble generator (22) configured to generate minute bubbles in water passing therethrough; a minute bubble water path (B) extending from the connecting port (21) and reaching into the wash tub from the first water feeding port (41) after passing through the minute bubble generator (22) and the detergent storing part (42) inside the water feeding case (40); a tap water path (A) extending from the connecting port (21) to the wash tub without passing through the minute bubble generator (22); a water supplying valve for tap water (31) provided midway of the tap water path (A) and capable of opening and closing the tap water path (A); and a water supplying valve for
(Continued)

minute bubble water (32) provided midway of the minute bubble water path (B) and capable of opening and closing the minute bubble water path (B).

11 Claims, 21 Drawing Sheets

(51) Int. Cl.

| | |
|---|---|
| ***D06F 39/02*** | (2006.01) |
| ***B01F 3/04*** | (2006.01) |
| ***B01F 5/06*** | (2006.01) |
| ***D06F 33/00*** | (2020.01) |
| ***D06F 35/00*** | (2006.01) |

(52) U.S. Cl.
CPC ..... *D06F 35/002* (2013.01); *D06F 39/02* (2013.01); *D06F 39/028* (2013.01); *D06F 39/08* (2013.01); *D06F 39/088* (2013.01)

(58) Field of Classification Search
CPC .... D06F 35/002; D06F 35/005; D06F 35/006; D06F 37/12; D06F 37/42; D06F 39/00; D06F 39/02; D06F 39/022; D06F 39/024; D06F 39/026; D06F 39/028; D06F 39/08; D06F 39/083; D06F 39/088; D06F 58/00; D06F 58/02; D06F 58/203; D06F 58/30–52; D06F 2101/00–20; D06F 2103/00–70; D06F 2105/00–62; D06F 2202/00–12; D06F 2204/00–10; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS

| | | | | |
|---|---|---|---|---|
| 2010/0181208 | A1 | 7/2010 | Denison et al. | |
| 2012/0125055 | A1* | 5/2012 | Lee ..... | D06F 39/02 68/17 R |
| 2016/0153134 | A1 | 6/2016 | Bang et al. | |

FOREIGN PATENT DOCUMENTS

| | | | | |
|---|---|---|---|---|
| CN | 102877271 | A | | 1/2013 |
| CN | 105297357 | A | | 2/2016 |
| DE | 11 2016 001 857 | T5 | | 1/2018 |
| EP | 2 527 509 | A1 | | 11/2012 |
| JP | 8-206390 | | | 8/1996 |
| JP | 2009178195 | A | * | 8/2009 |
| JP | 2009-226208 | | | 10/2009 |
| JP | 2011-115359 | | | 6/2011 |
| JP | 4796205 | | | 10/2011 |
| JP | 2012-515634 | | | 7/2012 |
| JP | 2014-158599 | | | 9/2014 |
| JP | 2016-7308 | | | 1/2016 |

OTHER PUBLICATIONS

Combined Chinese Office Action and Search Report dated Mar. 13, 2019 in Patent Application No. 201780013372.X (with English translation of category of cited documents), citing documents AA and AO-AR therein, 6 pages.
International Search Report dated Oct. 31, 2017 in PCT/JP2017/027873 filed on Aug. 1, 2017 (with English Translation).
German Office Action dated May 28, 2020 in German Patent Application No. 11 2017 004 124.4 (with English translation).

* cited by examiner

WASHING MACHINE

CROSS-REFERENCE TO RELATED APPLICATION(S)

This application is a continuation to an International Application No. PCT/JP2017/027873, filed on Aug. 1, 2017 which is based upon and claims the benefit of priority from Japanese Patent Application No. 2016-160539, filed on, Aug. 18, 2016, the entire contents of which are incorporated herein by reference.

TECHNICAL FIELD

Embodiments of the present invention relate to a washing machine.

BACKGROUND ART

In recent years, minute bubbles referred to as microbubbles and nanobubbles that have a diameter ranging between several tens of nanometers to several micrometers are gaining popularity and it is being conceived to use minute bubble water containing multiplicity of minute bubbles in a washing machine. However, in conventional configurations, it has not been possible to sufficiently exert the effects of the minute bubble water.

PRIOR ART DOCUMENT

Patent Document

Patent Document 1: Japanese Patent Application Publication No. 2014-158599 A

SUMMARY OF INVENTION

Problem Solved by Invention

Thus, there is provided a washing machine capable of improving the effect of the minute bubble water.

Solution to Problem

A washing machine according to an embodiment includes a wash tub configured by a water tub and a rotary tub; a connecting port connected to a water source; a water feeding case connected to the connecting port to receive water from the water source and containing a detergent storing part in which a detergent is stored; a first water feeding port configured to feed water flown into the water feeding case into the wash tub; a minute bubble generator configured to generate minute bubbles in water passing therethrough; a minute bubble water path extending from the connecting port and reaching into the wash tub from the first water feeding port after passing through the minute bubble generator and the detergent storing part inside the water feeding case; a tap water path extending from the connecting port to the wash tub without passing through the minute bubble generator; a water supplying valve for tap water provided midway of the tap water path and capable of opening and closing the tap water path; and a water supplying valve for minute bubble water provided midway of the minute bubble water path and capable of opening and closing the minute bubble water path.

EMBODIMENTS OF INVENTION

Embodiments are described hereinafter with reference to the drawings. Elements that are substantially identical across the embodiments are identified with identical reference symbols and are not re-described.

First Embodiment

A first embodiment is described hereinafter with reference to FIGS. 1 to 8.

Figure 1:
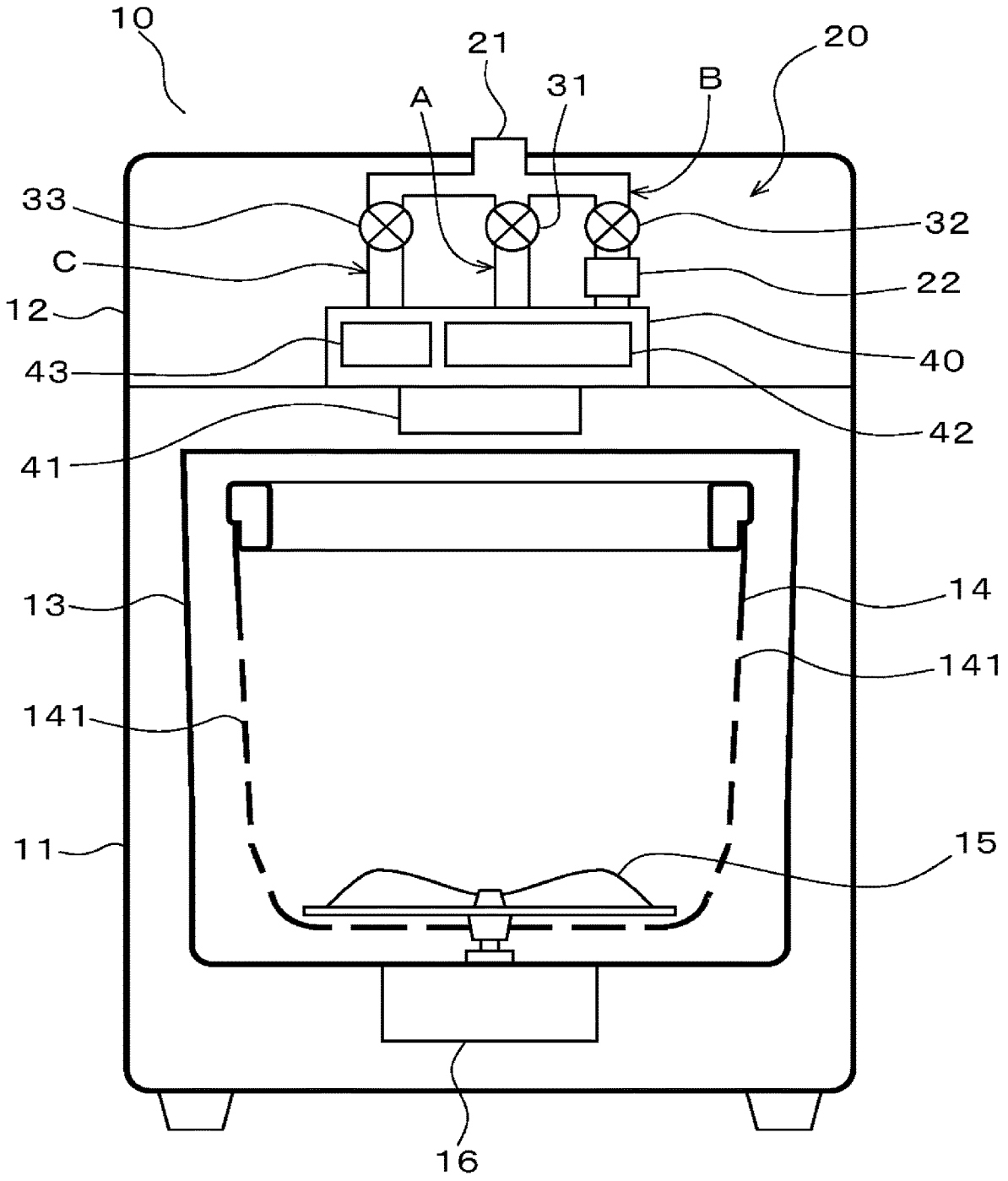
FIG. 1 is across sectional view schematically illustrating the structure of a washing machine according to a first embodiment from the front side.

A schematic configuration of a washing machine 10 is described with reference to FIGS. 1 to 6. The washing machine 10 illustrated in FIG. 1 is provided with an outer housing 11, a top cover 12, a water tub 13, a rotary tub, a pulsator 15, and a motor 16. The installation surface side of the washing machine 10, that is, the vertically lower side is defined as the lower side of the washing machine 10 and the side opposite the installation surface, that is, the vertically upper side is defined as the upper side of the washing machine 10. Further, the left and right direction of the page of FIG. 1 is defined as the left and right direction of the washing machine 10. The washing machine 10 is the so-called vertical axis washing machine in which the rotary shaft of the rotary tub 14 is oriented in the vertical direction. The washing machine is not limited to the vertical axis type but may be a lateral axis type or the so-called drum type washing machine in which the rotary shaft of the rotary tub is horizontal or rearwardly declined.

The outer housing 11 is generally formed into a rectangular box shape by a steel plate for example. The top cover 12 is made of synthetic resin for example and is provided on top of the outer housing 11. The water tub 13 and the rotary tub 14 function as a wash tub and a dehydration tub that store the clothes to be washed. The water tub 13 is provided inside the outer housing 11. The water tub 13 and the rotary tub 14 are configured as an open top container. The rotary tub 14 is provided with a plurality of small holes 141 and water flows between the rotary tub 14 and the water tub 13 through the small holes 141. Further, a drain port not shown is formed at the bottom of the water tub 13.

The motor 16 is connected to the rotary tub 14 and the pulsator 15 via a clutch mechanism not shown. The clutch mechanism not shown selectively transmits the rotation of the motor 16 to the rotary tub 14 and the pulsator 15. During the wash and the rinse steps, the motor 16 and the clutch mechanism not shown rotationally drive the pulsator 15 directly at low speed in the forward and reverse directions by transmitting the drive force of the motor 16 to the pulsator 15 with the rotation of the rotary tub 14 stopped. During the dehydration step and the like on the other hand, the motor 16 and the clutch mechanism not shown transmit the drive force of the motor 16 to the rotary tub 14 and rotationally drives the rotary tub 14 and the pulsator 15 in a single direction at high speed.

The washing machine 10 is provided with a water feeding device 20. The water feeding device 20 is provided inside the top cover 12 in the upper portion of the outer housing 11. The water feeding device 20 is provided with a connecting port 21, a minute bubble generator 22, a water supplying valve for tap water 31, a water supplying valve for minute bubble water 32, a water supplying valve for softener 33, a water feeding case 40, and a first water feeding port 41.

The connecting port 21 is connected to a water source such as a faucet of tap water via a hose not shown. The downstream side of the connecting port 21 is branched to form a plurality of paths. In this case, the downstream side of the connecting port 21 is branched into three paths namely, a tap water path A, a minute bubble water path B, and softener path C. In the present embodiment, each of the paths A, B, and C extends into the water tub 13 and the rotary tub 14 from the connecting port 21 via the water feeding case 40.

Figure 2:
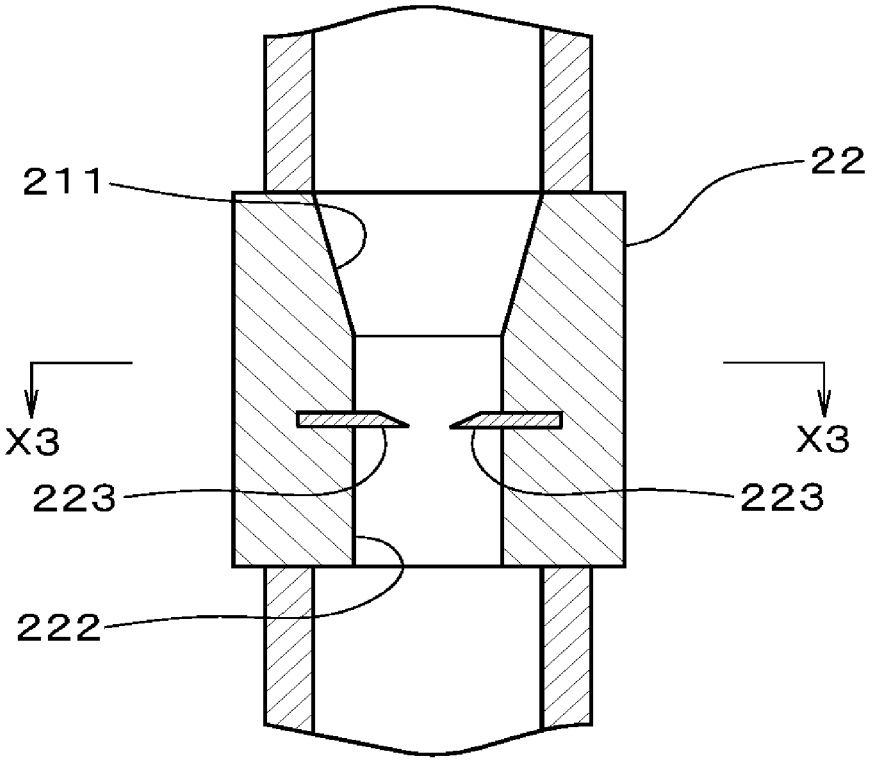
FIG. 2 is a cross sectional view schematically illustrating the structure of a minute bubble generator of the washing machine according to the first embodiment.
Figure 3:
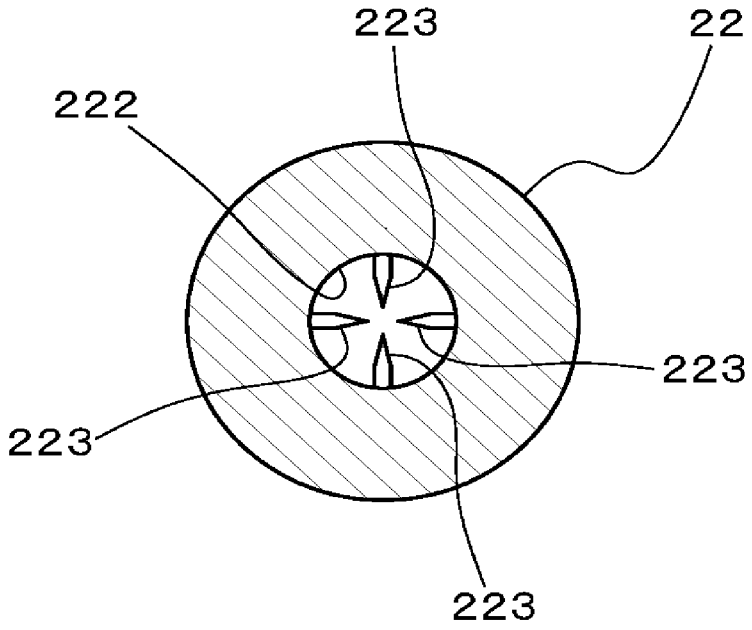
FIG. 3 is a cross sectional view taken along line X3-X3 of FIG. 2 of the washing machine according to the first embodiment.

The minute bubble generator 22 adds minute bubbles to the water passing therethrough. The minute bubble generator 22 is made of synthetic resin for example and is generally formed into a cylindrical shape as shown in FIGS. 2 and 3. The minute bubble generator 22 is provided with a narrowing part 221, a straight part 222, and a protrusion 223. The narrowing part 221 and the straight part 222 form a single continuous path. The narrowing part 221 serves as the input side and the straight part 222 serves as the output side.

The narrowing part 221 is formed in a shape in which the inner diameter thereof is reduced from the input side to the output side of the minute bubble generator 22, that is, in a conical tapered tube shape in which the cross sectional area of the flow path, that is, the inner diameter is continuously and gradually reduced. The straight part 222 is formed in a cylindrical shape, that is, in a straight tube shape in which the cross sectional area of the flow path, that is, the inner diameter does not change.

The protrusion 223 is provided in the intermediate portion of the longer side direction of the straight part 222. The protrusion 223 generates minute bubbles in the liquid passing through the straight part 222 by locally reducing the cross sectional area of the portion through which the liquid can pass in the straight part 222. In the present embodiment, a plurality of, in this case, four protrusions 223 are provided in the straight part 222. Each of the protrusions 223 is configured by a bar-shaped member having a sharpened tip and protrudes towards the center of the cross section of the straight part 222 from the inner peripheral surface of the straight part 222. Each of the protrusions 223 is disposed so as to be spaced from one another at equal intervals taken along the circumferential direction of the cross section of the straight part 222.

When water flows into the minute bubble generator 22 from the narrowing part 221 side, the flow velocity of the water is increased by the so-called Venturi effect of fluid dynamics due to the cross section of the flow path being narrowed from the narrowing part 221 to the straight part 222. Pressure is rapidly reduced by the high velocity flow colliding with the protrusions 223. It is thus, possible to precipitate air, dissolved in the water, as multiplicity of minute bubbles.

The minute bubble generator 22 of the present embodiment is capable of generating large amount of minute bubbles including nanobubbles having a diameter ranging approximately from 50 nm to 1 μm and microbubbles having a diameter ranging approximately from 1 μm to several hundred μm in a liquid by passing the liquid such as water through the minute bubble generator 22. In the following description, the water having passed through the minute bubble generator 22 and containing minute bubbles is referred to as a minute bubble water. Further, the water which has not passed through the minute bubble generator 22 and not containing minute bubbles is simply referred to as tap water. The minute bubble generator 22 is not limited to the so-called Venturi type described above.

The water supplying valve for tap water 31, the water supplying valve for minute bubble water 32, and the water supplying valve for softener 33 are liquid opening and closing valves capable of opening and closing electromagnetically. As shown in FIG. 1, the water supplying valve for tap water 31 is provided midway of the tap water path A, that is, midway of one of the three paths branching off of the connecting port 21, that is, the path different from the minute bubble water path B and the softener path C and is provided between the connecting port 21 and the water feeding case 40. The water supplying valve for tap water 31 is configured so as to be capable of opening and closing the tap water path A.

The water supplying valve for minute bubble water 32 is provided midway of the minute bubble water path B. That is, the water supplying valve for minute bubble water 32 is provided midway of one of the three paths branching off of the connecting port 21, that is, the path different from the tap water path A and the softener path C and is provided between the connecting port 21 and the water feeding case 40. The water supplying valve for minute bubble water 32 is configured so as to be capable of opening and closing the minute bubble water path B. The water supplying valve for minute bubble water 32 is provided in the upstream side of the minute bubble generator 22. That is, in the present embodiment, the minute bubble generator 22 is provided midway of the minute bubble water path B and is located between the water supplying valve for minute bubble water 32 and the water feeding case 40.

The water supplying valve for softener 33 is provided midway of the softener path C. That is, the water supplying valve for softener 33 is provided midway of one of the three paths branching off of the connecting port 21, that is, the path different from the tap water path A and the minute bubble water path B and is provided between the connecting port 21 and the water feeding case 40. The water supplying valve for softener 33 is configured so as to be capable of opening and closing the softener path C.

Figure 4:
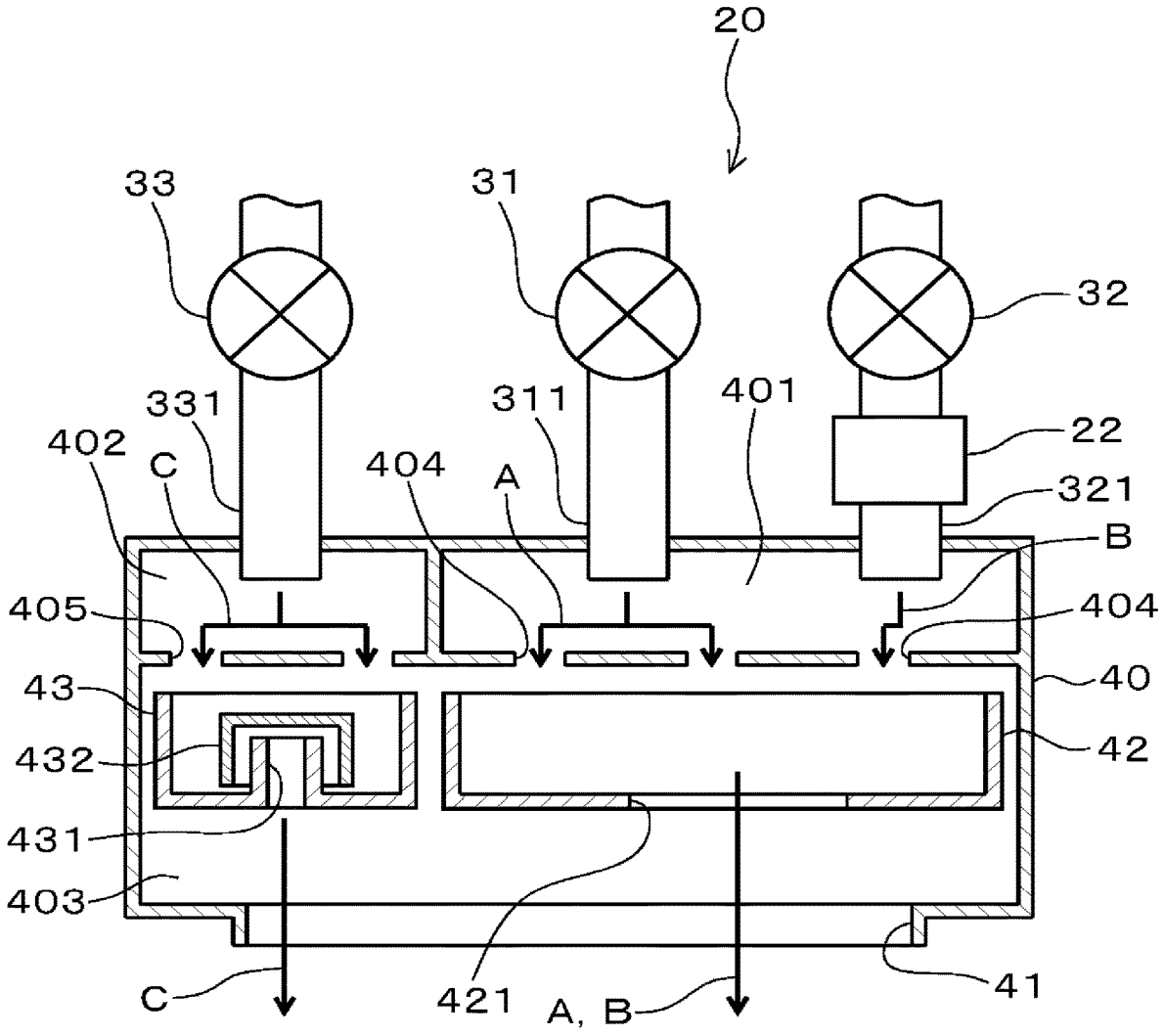
FIG. 4 is a cross sectional view schematically illustrating the structure inside a water feeding case of the washing machine according to the first embodiment from the front side.
Figure 5:
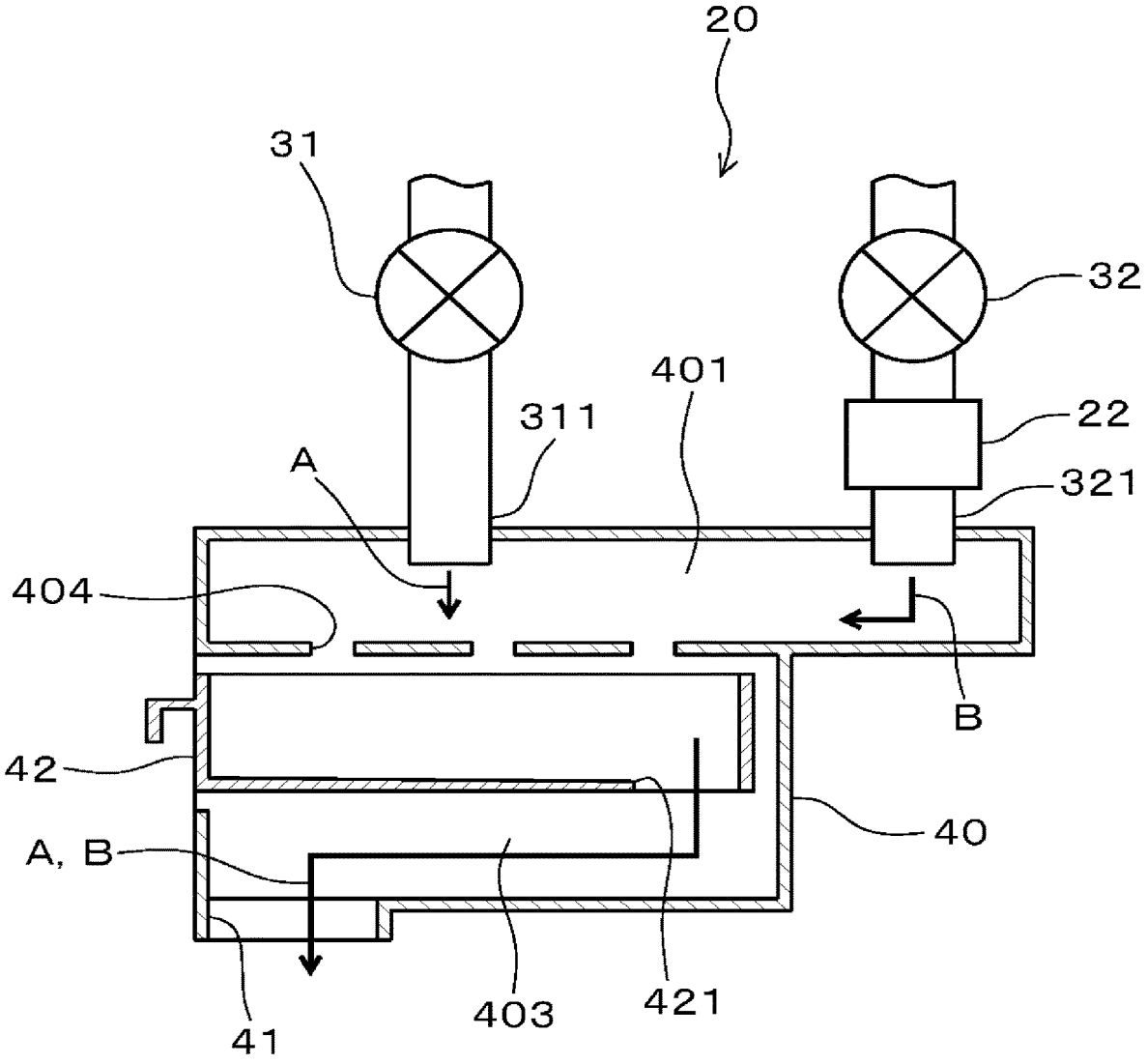
FIG. 5. is a cross sectional view schematically illustrating the structure inside a water feeding case of the washing machine according to the first embodiment from the side.

The water feeding case 40 is connected to the connecting port 21 via each of the water supplying valves 31, 32, and 33. The water feeding case 40 receives water supplied from the connecting port 21 and feeds the received water to the water tub 13 and the rotary tub 14. The water feeding case 40 is formed into a shape of a container made of synthetic resin for example. The interior of the water feeding case 40 is divided into a first upper space 401, a second upper space 402, and a lower space 403 as shown in FIG. 4. The first upper space 401 and the second upper space 402 are mutually independent spaces. The first upper space 401 and the lower space 403 communicate through a plurality of first communicating holes 404. The second upper space 402 and the lower space 403 communicate through a plurality of second communicating holes 405.

The first water feeding port 41 communicates the lower space 403 of the water feeding case 40 with the exterior and feeds the water flowing into the water feeding case 40 to the water tub 13 and the rotary tub 14. In the present embodiment, the first water feeding port 41 is provided above the water tub 13 and the rotary tub 14 as shown in FIG. 1 where it is visible from the user when the user uses the washing machine 10. Further in the present embodiment, the first water feeding port 41 is formed integrally with the water feeding case 40. The first water feeding port 41 may be configured to be separate from the water feeding case 40. Piping member such as a hose may be provided between the water feeding case 40 and the first water feeding port 41.

As shown in FIGS. 1 and 4, the water feeding device 20 is provided with a detergent storing part 42 and a softener storing part 43. The detergent storing part 42 is shaped like container having an open top. The detergent storing part 42 is provided inside the lower space 403 of the water feeding case 40 so as to be located below the first upper space 401 and is configured to be drawable from the water feeding case 40. Further, the detergent storing part 42 is provided with a water passing part 421. The water passing part 421 is formed so as to penetrate through the bottom of the container-shaped detergent storing part 42 and is opened towards the downward direction. Detergent is stored in the detergent storing part 42. That is, when using the washing machine 10, the user is to draw out the detergent storing part 42 and supply the detergent into the detergent storing part 42.

The softener storing part 43 is shaped like a container having an open top. The softener storing part 43 is provided inside the lower space 403 of the water feeding case 40 so as to be located below the second upper space 402 and is configured so as to be drawable. The softener storing part 43 is provided with a cylindrical part 431 and a covering part 432. The cylindrical part 431 is formed in a cylindrical shape that protrudes upward from the bottom of the container shaped softener storing part 43 and communicates the inner side of the container shaped softener storing part 43 with the lower exterior of the softener storing part 43. The covering part 432, being separated from the bottom and the cylindrical part 431 of the softener storing part 43, covers the periphery of the cylindrical part 431. In this case, the cylindrical part 431 and the covering part 432 take a syphon structure. Softener is stored inside the softener storing part 43. That is, when using the washing machine 10, the user is to draw out the softener storing part 43 as required and supply the softener into the softener storing part 43.

Further, a discharging side 311 of the water supplying valve for tap water 31 is connected to the interior of the first upper space 401 of the water feeding case 40. A discharging side 321 of the water supplying valve for minute bubble water 32 is connected to the interior of the first upper space 401 of the water feeding case 40 via the minute bubble generator 22. A discharging side 331 of the water supplying valve for softener 33 is connected to the interior of the second upper space 402 of the water feeding case 40.

Under the above described configuration, when the water supplying valve for tap water 31 is opened, the tap water not containing minute bubbles flows into the first upper space 401 of the water feeding case 40 without passing through the minute bubble generator 22. The tap water flown into the first upper space 401 falls to the detergent storing part 42 inside the lower space 403 through the first communicating holes 404. The tap water which has fallen into the detergent storing part 42 falls to the bottom side of the water feeding case 40 from the water passing part 421 of the detergent storing part 42 and is thereafter fed into the water tub 13 and the rotary tub 14 from the first water feeding port 41. At this time, when detergent is stored in the detergent storing part 42, the detergent is dissolved by the tap water supplied through the tap water path A and is washed down into the water tub 13 and the rotary tub 14 from the first water feeding port 41.

Further, when the water supplying valve for minute bubble water 32 is opened, the minute bubble water containing minute bubbles after passing through the minute bubble generator 22 flows into the first upper space 401 of the water feeding case 40. The minute bubble water flown into the first upper space 401 falls to the detergent storing part 42 inside the lower space 403 through the first communicating holes 404. The minute bubble water which has fallen into the detergent storing part 42 falls to the bottom side of the water feeding case 40 from the water passing part 421 of the detergent storing part 42 and is thereafter fed into the water tub 13 and the rotary tub 14 from the first water feeding port 41. At this time, when detergent is stored in the detergent storing part 42, the detergent is dissolved by the minute bubble water supplied through the minute bubble water path B and is washed down into the water tub 13 and the rotary tub 14 from the first water feeding port 41.

Further, when the water supplying valve for softener 33 is opened, the tap water not containing minute bubbles which has not passed through the minute bubble generator 22 flows into the second upper space 402 of the water feeding case 40. The tap water flown into the second upper space 402 falls to the softener storing part 43 inside the lower space 403 through the second communicating holes 405. When a certain amount of water is stored in the softener storing part 43, the water falls to the bottom side of the water feeding case 40 by passing through the inner side of the cylindrical part 431 by the syphon mechanism configured by the cylindrical part 431 and the covering part 432 and is thereafter fed into the water tub 13 and the rotary tub 14 from the first water feeding port 41. At this time, when softener is stored in the softener storing part 43, the softener is dissolved by the tap water supplied through the softener path C and is washed down into the water tub 13 and the rotary tub 14 from the first water feeding port 41.

In the above described configuration, the tap water path A passes through the detergent storing part 42 inside the water feeding case 40 from the connecting port 21 and thereafter extends into the water tub 13 and rotary tub 14 through the first water feeding port 41. In this case, the tap water path A does not pass through the minute bubble generator 22. That is, the tap water path A is a path having the connecting port 21 as a start point and the interior of the water tub 13 and the rotary tub 14 as an end point and passing through the detergent storing part 42 of the water feeding case 40 without passing through the minute bubble generator 22.

The minute bubble water path B passes through the minute bubble generator 22 from the connecting port 21 and extends into the water tub 13 and the rotary tub 14 through the first water feeding port 41 after passing through the detergent storing part 42 of the water feeding case 40. In this case, the minute bubble water path B is a path that passes through the minute bubble generator 22. That is, the minute bubble water path B is a path having the connecting port 21 as a start point and the interior of the water tub 13 and the rotary tub 14 as an end point and passing through the minute bubble generator 22 and the detergent storing part 42 of the water feeding case 40.

In the water feeding case 40, the tap water path A and the minute bubble water path B merge in the first upper space 401 before reaching the detergent storing part 42. In this case, because the cross section of the flow path is narrowed by the minute bubble generator 22, the amount of water passing through the minute bubble water path B, that is, the amount of minute bubble water flowing into the water feeding case 40 is less than the amount of water passing through the tap water path A that is, the amount of tap water flowing into the water feeding case 40.

Further, the softener path C extends from the connecting port 21 and into the water tub 13 and the rotary tub 14 through the first water feeding port 41 after passing through the softener storing part 43 inside the water feeding case 40. In this case, the softener path C does not pass through the minute bubble generator 22. That is, the softener path C is a path having the connecting port 21 as a start point and the interior of the water tub 13 and the rotary tub 14 as an end point and passing through the softener storing part 43 of the water feeding case 40 without passing through the minute bubble generator 22. The softener path C may be configured to pass through the minute bubble generator 22.

Figure 6:
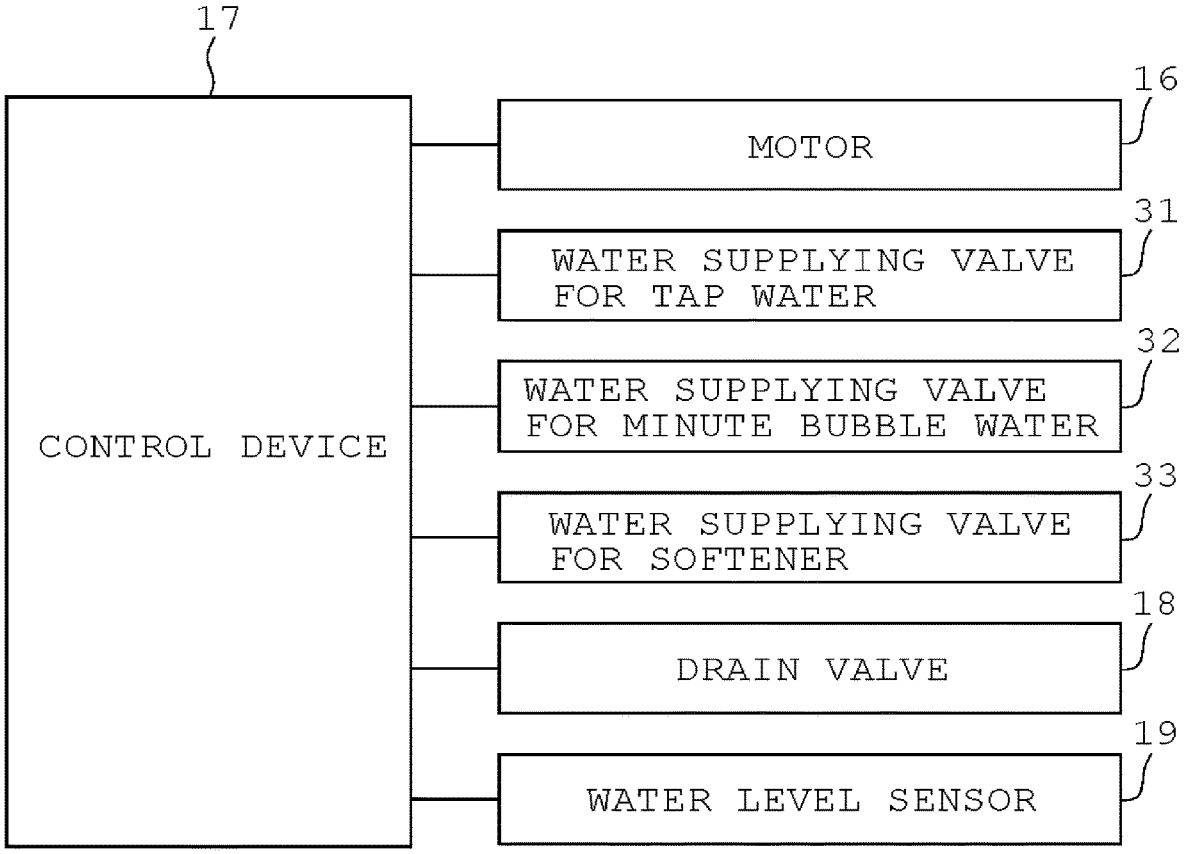
FIG. 6 is a block diagram illustrating the electrical configuration of the washing machine according to the first embodiment.

Further, the washing machine 10 is provided with a control device 17 as shown in FIG. 6. The control device 17 is configured by a microcomputer and the like, and controls the overall operation of the washing machine 10. The motor 16 and each of the water supplying valves 31, 32, and 33 are electrically connected to the control device 17 and are drive controlled based on the control signals given from the control device 17. Further, the washing machine 10 is provided with a drain valve 18 and a water level sensor 19. The drain valve 18 is for opening and closing a drain port not shown formed at the bottom of the water tub 13. The water level sensor 19 is for measuring the level of water stored inside the water tub 13. The drain valve 18 and the water level sensor 19 are also electrically connected to the control device 17.

Next, a description will be given on the controls of the washing operation performed by the control device 17 with reference to FIGS. 7 and 8.

Figure 7:
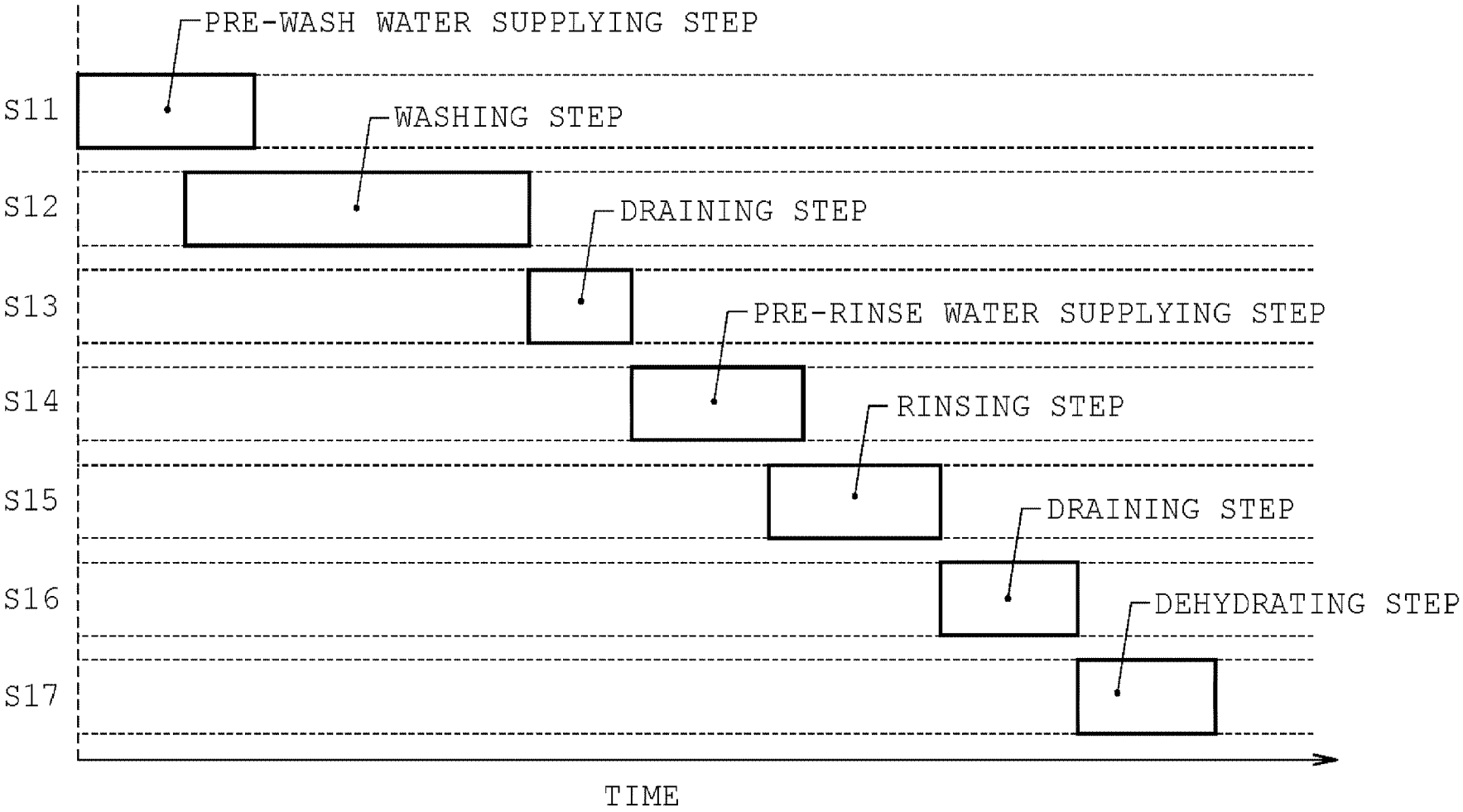
FIG. 7 is a chart chronologically indicating the steps executed in a washing operation of the washing machine according to the first embodiment.

In the present embodiment, the control device 17 sequentially executes a pre-wash water supplying step of step S11, a washing step of step S12, a draining step of step S13, a pre-rinse water supplying step of step S14, a rinsing step of step S15, a draining step of step S16, and a dehydrating step of step S17 as shown in FIG. 7 when executing a washing operation. The amount of water supplied in the pre-wash water supplying step of step S11 and the pre-rinse water supplying step of step S14 and the duration of the wash step of step S12 and the dehydrating step of step S17 may be modified as required depending upon the amount of clothes being washed or user preference. The duration and the times of the rinsing step of step S15 may also be modified as required depending upon the amount of clothes being washed or user preference. In this case, the times of pre-rinse water supplying step of step S14 and the draining step of step S16 are modified depending upon the times of the rinse step of step S15.

The pre-wash water supplying step of step S11 is a step of feeding the wash water dissolving the detergent in the detergent storing part 42 into the water tub 13 and the rotary tub 14 by operating the water feeding device 20 prior to the wash step of step S12. The pre-wash water supplying step of step S11 is a water supplying step performed first among the plurality of water supplying steps performed during the washing operation. The wash step of step S12 is a step of performing the wash by agitating the clothes inside the rotary tub 14 by relatively rotating the pulsator 15 with respect to the rotary tub 14 by driving the motor 16. The draining step of step S13 is a step of draining the wash water stored in the water tub 13 by opening the drain valve 18.

The pre-rinse water supplying step of step S14 is a step of feeding rinse water in which the detergent is not dissolved into the wash tub 13 and the rotary tub 14 by operating the water feeding device 20 prior to the rinse step of step S15. The draining step of step S16 is a step of draining the rinse water stored in the water tub 13 by opening the drain valve 18 as was the case in the draining step of step S13. The dehydration step of step S17 is a step of dehydrating the clothes inside the rotary tub 14 by centrifugal force by driving the motor 16 and rotating the rotary tub 14 at high speed.

In the present embodiment, the pre-wash water supplying step of step S11 is performed by opening only the water supplying valve for minute bubble water 32 among the water supplying valves 31, 32, and 33. That is, in the present embodiment, the pre-wash water supplying step of step S11 is performed solely by the water passing through the minute bubble water path B that is, the minute bubble water which has passed through the minute bubble generator 22 and containing minute bubbles.

Figure 8:
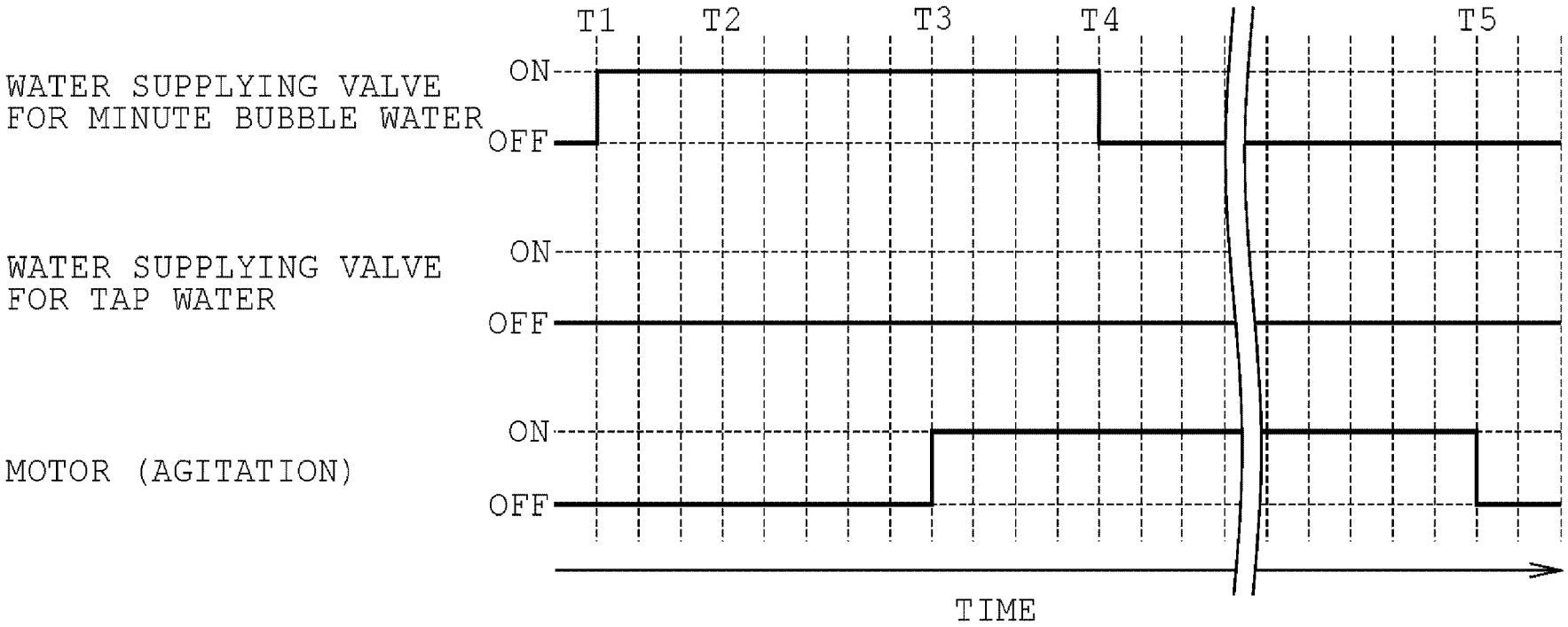
FIG. 8 is a timing chart chronologically indicating the operation of each component in a pre-wash water supplying step and a wash step of the washing machine according to the first embodiment.

More specifically, in the present embodiment, when the control device 17 executes the pre-wash water supplying step of step S11, the water supplying valve for minute bubble water 32 is opened at time T1 as indicated in FIG. 8. In this case, other water supplying valves 31 and 33 are closed. Thus, minute bubble water passed through the minute bubble generator 22 and containing minute bubbles is fed into the water tub 13 and the rotary tub 14 from the first water feeding port 41 with the detergent dissolved therein when passing through the detergent storing part 42. That is, according to the above described configuration, in the pre-wash water supplying step, the tap water supplied from the faucet of tap water turns into a minute bubble water containing minute bubbles and a wash water containing detergent when passing through the minute bubble water path B and is fed into the water tub 13 and the rotary tub 14 from the first water feeding port 41.

The time at which the detergent supplied to the detergent storing part 42 dissolves into the minute bubble water and is washed down into the water tub 13 and the rotary tub 14 is defined as time T2. That is, time T2 is a time at which the detergent stored in the detergent storing part 42 is presumed to be sufficiently washed down by the minute bubble water flowing through the minute bubble water path B after the water supplying valve for minute bubble water 32 has been opened. Time T2 is preset prior to the washing operation. The control device 17 may manage time T2 depending upon the amount of water supplied from the water supplying valve for minute bubble water 32.

The time period from time T1 at which the water supplying valve for minute bubble water 32 is opened to time T2 at which the detergent stored in the detergent storing part 42 is dissolved in the minute bubble water and washed down into the water tub 13 and the rotary tub 14 is defined as a first period T1-T2. That is, the first period T1-T2 is a period in which only the minute bubble water containing minute bubbles is supplied to the detergent storing part 42 through the minute bubble generator 22 by opening the water supplying valve for minute bubble water 32 at or before the timing in which the detergent stored in the detergent storing part 42 is washed down into the water tub 13 and the rotary tub 14.

The surfactant in the detergent and the minute bubble in the minute bubble water each has a cleaning capacity to remove soil independently. However, when minute bubble water is added to concentrated detergent water by dissolving detergent in a minute bubble water for example, the surfactants in the detergent are adsorbed to the minute bubbles by the operation of surface charge of the minute bubbles and thereby deagglomerates the surfactants to facilitate the dispersion of the surfactants in the water. As a result, the surfactants become susceptible to reacting with the soil in a short period of time to improve the cleaning capacity. That is, by generating wash water by dissolving detergent in the minute bubble water, the surfactants in the detergent interact with the minute bubbles in the minute bubble water to significantly improve the cleaning capacity compared to a simple minute bubble water or a simple wash water in which the detergent is simply dissolved in the tap water. Further, because the soil is emulsified and become susceptible to dispersing in the water, it is also expected to prevent reattachment of the soil to the clothes.

When the control device 17 detects that the water has been fed to a predetermined water level inside the water tub 13, the control device 17 operates the motor 16 as indicated at time T3 of FIG. 8 to relatively rotate the pulsator 15 and the rotary tub 14 at low speed. As a result, the washing step of step S12 is started during the pre-wash water supplying step of step S11 as indicated in FIG. 7. In this case, the predetermined water level at which step S12 is started, that is, the water level inside the water tub 13 at time T3 is set to a water level lower than the water level ultimately reached in the pre-wash water supplying step of step S11 that is, the preset water level.

Then, when the control device 17 detects that water has been fed to the preset water level in the water tub 13, the control device 17 closes the water supplying valve for minute bubble water 32 as indicated at time T4 and stops feeding water into the water tub 13. Thus, the control device 17 terminates the pre-wash water supplying step performed at step S11 of FIG. 7. The entire period in which water is being fed into the water tub 13 by the water feeding device 20, that is, the period from time T1 to time T4 is defined as water supplying period T1-T4. The control device 17 continues to agitate the clothes inside the rotary tub 14 by driving the motor 16 for a predetermined time period from time T3, and thereafter stops the motor 16 at time T5. Thus, the control device 17 terminates the washing step performed at step S12 of FIG. 7.

In contrast, in the pre-rinse water supplying step performed at step S14 of FIG. 7, only the water supplying valve for tap water 31 or both the water supplying valve for tap water 31 and the water supplying valve for minute bubble water 32 are opened. Thus, the water supplied from the faucet of tap water and the like passes through only the tap water path A or the tap water path A and the minute bubble water path B to be fed into the water tub 13 and the rotary tub 14 from the first water feeding port 41. It is possible to feed water by opening the water supplying valve for minute bubble water 32 alone in the pre-rinse water supplying step of step S14 as well.

According to the embodiment described above, the washing machine 10 is provided with the minute bubble water path B. The minute bubble water path B is a path extending from the connecting port 21 and into the water tub 13 and the rotary tub 14 through the first water feeding port 41 after passing through the minute bubble generator 22 and the detergent storing part 42 inside the water feeding case 40.

That is, the washing machine 10 has a first period in the initial water supplying step of the washing operation. The first period is a period in which only minute bubble water containing minute bubbles is supplied to the detergent storing part 42 through the minute bubble generator 22 by opening the water supplying valve for minute bubble water 32 at or before the timing in which the detergent supplied to the detergent storing part 42 is washed down into the water tub 13 and the rotary tub 14.

Thus, it is possible to wash down the detergent in the detergent storing part 42 by the minute bubble water by opening the water supplying valve for minute bubble water 32 at the initial water supplying step of the washing operation. That is, it is possible to provide a wash water in which the detergent is dissolved in the minute bubble water. As a result, it is possible to significantly improve the cleaning capacity by the interaction of the surfactant in the detergent and the minute bubbles in the minute bubble water compared to a simple minute bubble water or a simple wash water in which the detergent is merely dissolved in the tap water. As a result, it is possible to sufficiently improve and exert the effect of the minute bubble water.

Second Embodiment

Next, a second embodiment will be described with reference to FIG. 9.

The second embodiment differs from the first embodiment in the content of pre-wash water supplying step of step S11 indicated in FIG. 7. More specifically, the control device 17, when executing the pre-wash water supplying step of step S11, opens the water supplying valve for minute bubble water 32 at time T1 as was the case in the first embodiment as shown in FIG. 9. Next, at time T2, the control device 17 closes the water supplying valve for minute bubble water 32 and opens the water supplying valve for tap water 31. Thus, only the tap water which has passed through the tap water path A is fed from the first water feeding port 41.

Figure 9:
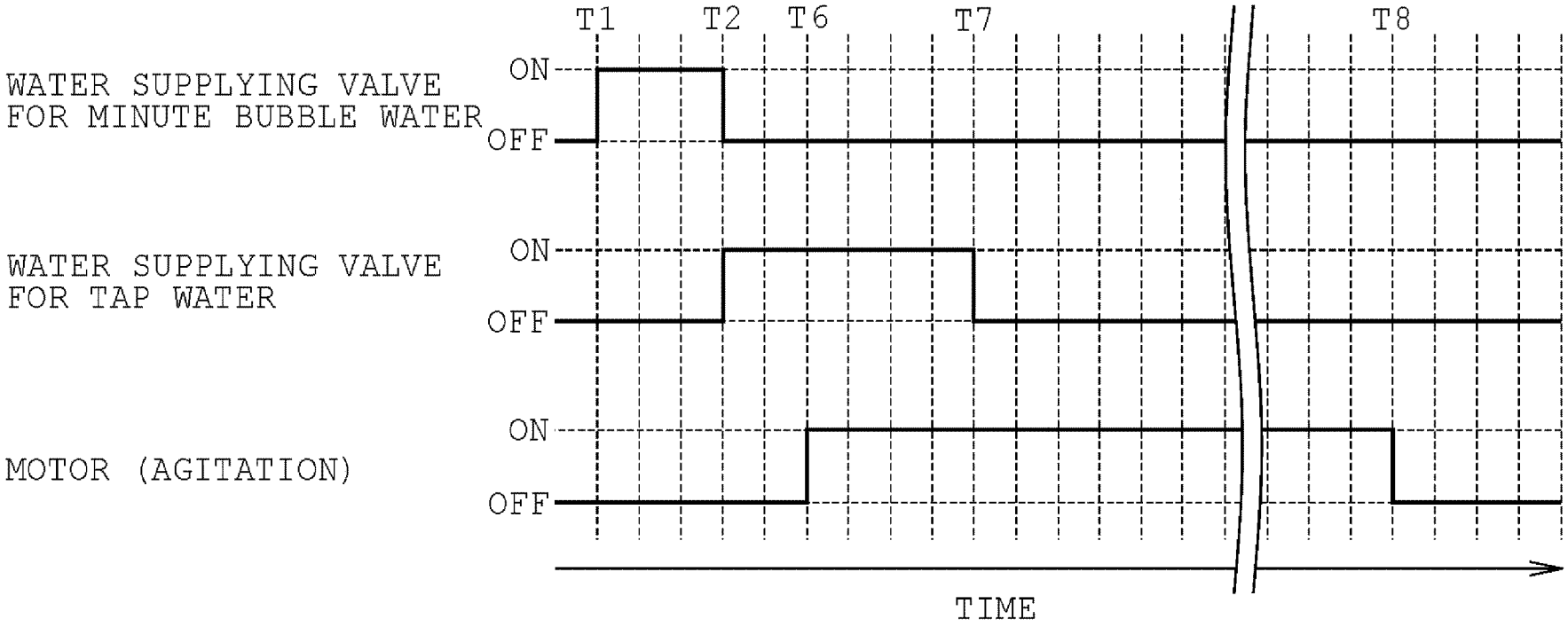
FIG. 9 is a timing chart chronologically indicating the operation of each component in the pre-wash water supplying step and the wash step of the washing machine according to a second embodiment.

Next, when detecting that water has been fed to the predetermined water level in the water tub 13, the control device 17 operates the motor 16 to relatively rotate the pulsator 15 and the rotary tub 14 at low speed as indicated at time T6 in FIG. 9. Thus, the wash step of step S12 is started during the pre-wash water supplying step of step S11 as indicated in FIG. 7. The predetermined water level when step S12 is started, that is, the water level inside the water tub 13 at time T6 is substantially the same as the water level inside water tub 13 at time T3 of FIG. 8 in the first embodiment.

Then, when detecting that water has been fed to the set water level inside the water tub 13, the control device 17 closes the water supplying valve for tap water 31 and stops feeding water to the water tub 13 as indicated at time T7. Thus, the control device 17 terminates the pre-wash water supplying step of step S11 of FIG. 7. The control device 17 continues to drive the motor 16 for a predetermined period to agitate the clothes inside the rotary tub 14 from time T6 and thereafter stops the motor 16 as indicated at time T8. Thus, the control device 17 terminates the wash step of step S12 of FIG. 7.

As indicated in FIG. 9, the period from time T2 when the water supplying valve for minute bubble water 32 is closed and the water supplying valve for tap water 31 is opened to time T7 when the water level inside the water tub 13 has reached the set water level is defined as a second period T2-T7. That is, the second period T2-T7 is a period in which water is fed to the set water level by closing the water supplying valve for minute bubble water 32 and opening the water supplying valve for tap water 31. Further, the entire period in which water is being fed into the water tub 13 by the water feeding device 20, that is, the period from time T1 to time T7 is defined as a water supplying period T1-T7.

The water feeding amount per unit time, that is, the flow rate is proportional to the cross sectional area of the path through which the water passes when the water supplying pressure is constant. In this case, since the minute bubble water path B is provided with the minute bubble generator 22 midway of its path for narrowing the flow path area, the flow rate of water flowing through the minute bubble water path B is smaller than the flow rate of water flowing through the tap water path A. That is, the flow rate of tap water flowing through the tap water path A is larger than the flow rate of minute bubble water flowing through the minute bubble water path B. Thus, the amount of water fed per unit time when water is fed only through the tap water path A is larger than the amount of water fed per unit time when water is fed only through the minute bubble water path B. Hence, when the set water levels in the pre-wash water supplying step of step S11 are the same, the water supplying period T1-T7 of the second embodiment is shorter than the water supplying period T1-T4 of the first embodiment.

Thus, in the present embodiment, the pre-wash water supplying step of step S11 is further provided with the second period T2-T7 that feeds water to the set water level by closing the water supplying valve for minute bubble water 32 and opening the water supplying valve for tap water 31 after the lapse of the first period T1-T2. Thus, it is possible to turn the wash water into minute bubble water dissolving detergent as was the case in the first embodiment by feeding the minute bubble water passing through the minute bubble water path B during the first period T1-T2. As a result, it is possible to significantly improve the cleaning capacity of the wash water and sufficiently improve and exert the effects of the minute bubble water.

By feeding water up to the set water level by closing the water supplying valve for minute bubble water 32 and opening the water supplying valve for tap water 31 after the lapse of the first period T1-T2, it is possible to make the water supplying period T2-T7 until reaching the set water level to be shorter than the water supplying period T1-T3 of the first embodiment. That is, according to the present embodiment, it is possible to complete the water supplying step of step S11 in a shorter time period compared to the first embodiment while improving the effect of the minute bubble water and consequently reduce the overall time of the washing operation.

Third Embodiment

Next, a description will be given on a third embodiment with reference to FIG. 10.

The third embodiment differs from each of the above described embodiments in the content of the pre-wash water supplying step of step S11 of FIG. 7. More specifically, when executing the pre-wash water supplying step of step S11, the control device 17 opens the water supplying valve for minute bubble water 32 at time T1 as was the case in each of the above described embodiments as indicated in FIG. 10. Then, at time T2, the control device 17 opens the water supplying valve for tap water 31 with the water supplying valve for minute bubble water 32 opened. Thus, both the tap water passing through the tap water path A and the minute bubble water passing through the minute bubble water path B are fed from the first water feeding port 41.

Figure 10:
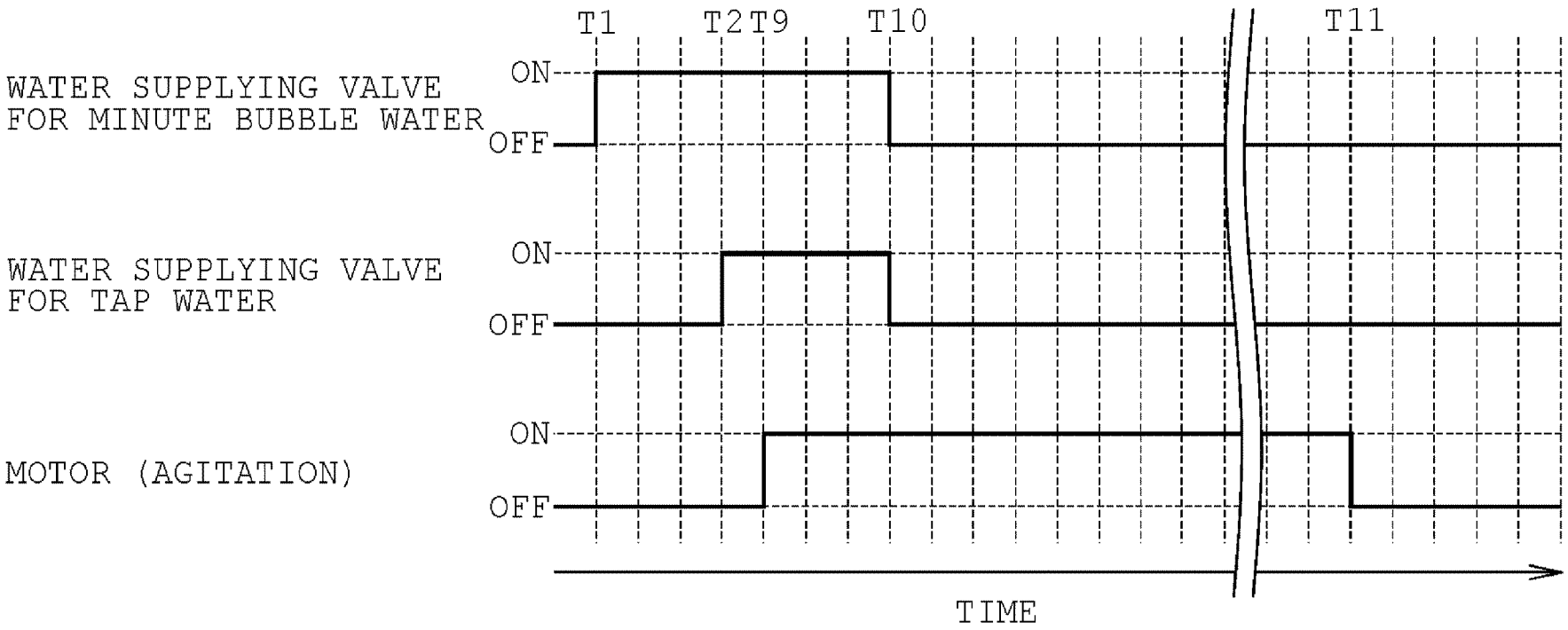
FIG. 10 is a timing chart chronologically indicating the operation of each component in the pre-wash water supplying step and the wash step of the washing machine according to a third embodiment.

Next, when detecting that water has been fed to the predetermined water level in the water tub 13, the control device 17 operates the motor 16 to relatively rotate the pulsator 15 and the rotary tub 14 at low speed as indicated at time T9 in FIG. 10. Thus, the wash step of step S12 is started during the pre-wash water supplying step of step S11 as indicated in FIG. 10. The predetermined water level when step S12 is started, that is, the water level inside the water tub 13 at time T9 is substantially the same as the water levels inside water tub 13 at time T3 of FIG. 8 in the first embodiment and at time T6 of FIG. 9 in the second embodiment.

Then, when detecting that water has been fed to the set water level inside the water tub 13, the control device 17 closes the water supplying valve for tap water 31 and the water supplying valve for minute bubble water 32 and stops feeding water to the water tub 13 as indicated at time T10. The control device 17 continues to drive the motor 16 for a predetermined period from time T9 to agitate the clothes inside the rotary tub 14 and thereafter stops the motor 16 as indicated at time T11. Thus, the control device 17 terminates the wash step of step S12 of FIG. 7.

As shown in FIG. 10, the period from time T2 when both the water supplying valve for tap water 31 and the water supplying valve for minute bubble water 32 are opened to time T10 when the water level inside the water tub 13 has reached the set water level is defined as a third period T2-T10. That is, the third period T2-T10 is the period when water is fed to the set water level by opening both the water supplying valve for minute bubble water 32 and the water supplying valve for tap water 31. Further, the entire period in which water is fed into the water tub 13 by the water feeding device 20, that is, the period from time T1 to time T10 is defined as water supplying period T1-T10.

The amount of water fed per unit time is proportional to the cross sectional area of the path through which the water passes. Thus, the amount of water fed per unit time when water is fed through both the tap water path A and the minute bubble water path B is greater than the amount of water fed per unit time when water is fed only through the minute bubble water path B and the amount of water fed per unit time when water is fed only through the tap water path A. Hence, when the set water levels in the pre-wash water supplying step at step S11 are the same, the water supplying period T1-T11 of the third embodiment is shorter than the water supplying period T1-T4 of the first embodiment and the water supplying period T1-T7 of the second embodiment.

Thus, in the present embodiment, the pre-wash water supplying step of step S11 is further provided with the third period T1-T10 that feeds water to the set water level by opening both the water supplying valve for minute bubble water 32 and the water supplying valve for tap water 31 after the lapse of the first period T1-T2. Thus, it is possible to turn the wash water into a minute bubble water dissolving detergent as was the case in the first embodiment and the second embodiment by feeding minute bubble water passing through the minute bubble water path B during the first period T1-T2. As a result, it is possible to significantly improve the cleaning capacity of the wash water and sufficiently improve and exert the effects of the minute bubble water.

Further, by feeding water up to the set water level by opening both the water supplying valve for minute bubble water 32 and the water supplying valve for tap water 31 after the lapse of the first period T1-T2, it is possible to make the water supplying period T2-T10 until reaching the set water level to be shorter than water supplying period T1-T3 of the first embodiment and the water supplying period T1-T7 of the second embodiment. That is, according to the present embodiment, it is possible to complete the water supplying step of step S11 in a shorter time period compared to the first embodiment and the second embodiment while improving the effect of the minute bubble water and consequently reduce the overall time of the washing operation.

Fourth Embodiment

Next, a description will be given on a fourth embodiment with reference to FIG. 11.

In the fourth embodiment, the structure of the water feeding case 40*a* differs from those of the above described embodiments. Elements that differ in the shape or the like from the structures of the above described embodiments are identified by a reference symbol suffixed by "a".

In the present embodiment, the water feeding case 40*a* is further provided with a passing space 406. The passing space 406 is provided inside the water feeding case 40*a*. The lower portion of the passing space 406 communicates with the lower space 403. The discharging side 311 of the water supplying valve for tap water 31 is connected into the passing space 406 of the water feeding case 40*a*. Thus, the tap water path A merges with the minute bubble water path B in the water feeding case 40*a* without passing through the detergent storing part 42. Stated differently, the minute bubble water path B merges with the tap water path A in the water feeding case 40*a* after passing through the detergent storing part 42.

The controls performed in the pre-wash water supplying step of step S11 indicated in FIG. 10 may employ any of the configurations of the first to the third embodiments.

Thus, the detergent stored in the detergent storing part 42 is dissolved only by the minute bubble water and hence, the dispersion of the surfactant described above is carried out efficiently while also allowing the reduction of the water supplying period to thereby provide the operation and effect similar to those of the above described embodiments.

Fifth Embodiment

Figure 12:
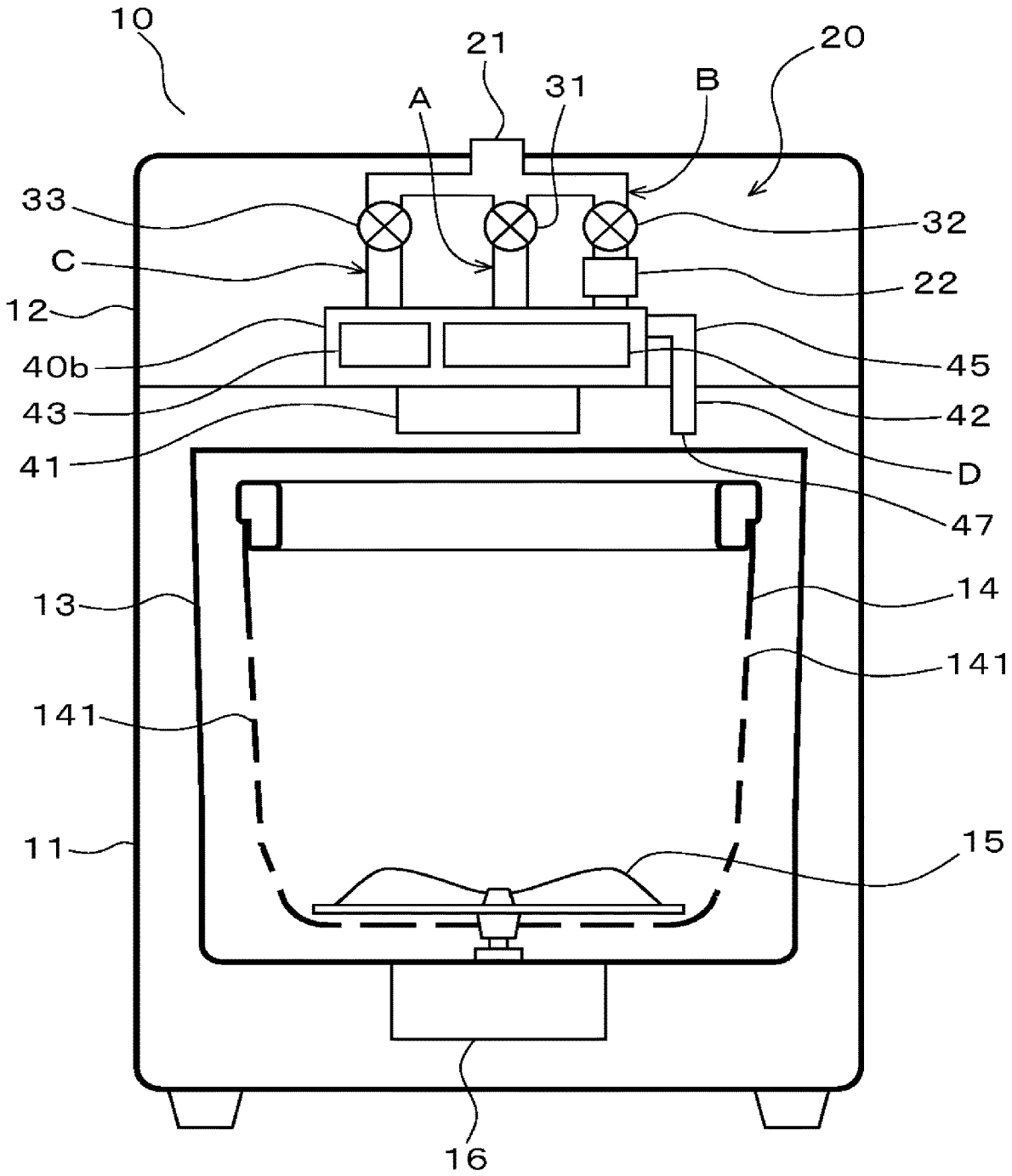
FIG. 12 is a cross sectional view schematically illustrating the structure of the washing machine according to a fifth embodiment from the front side.
Figure 13:
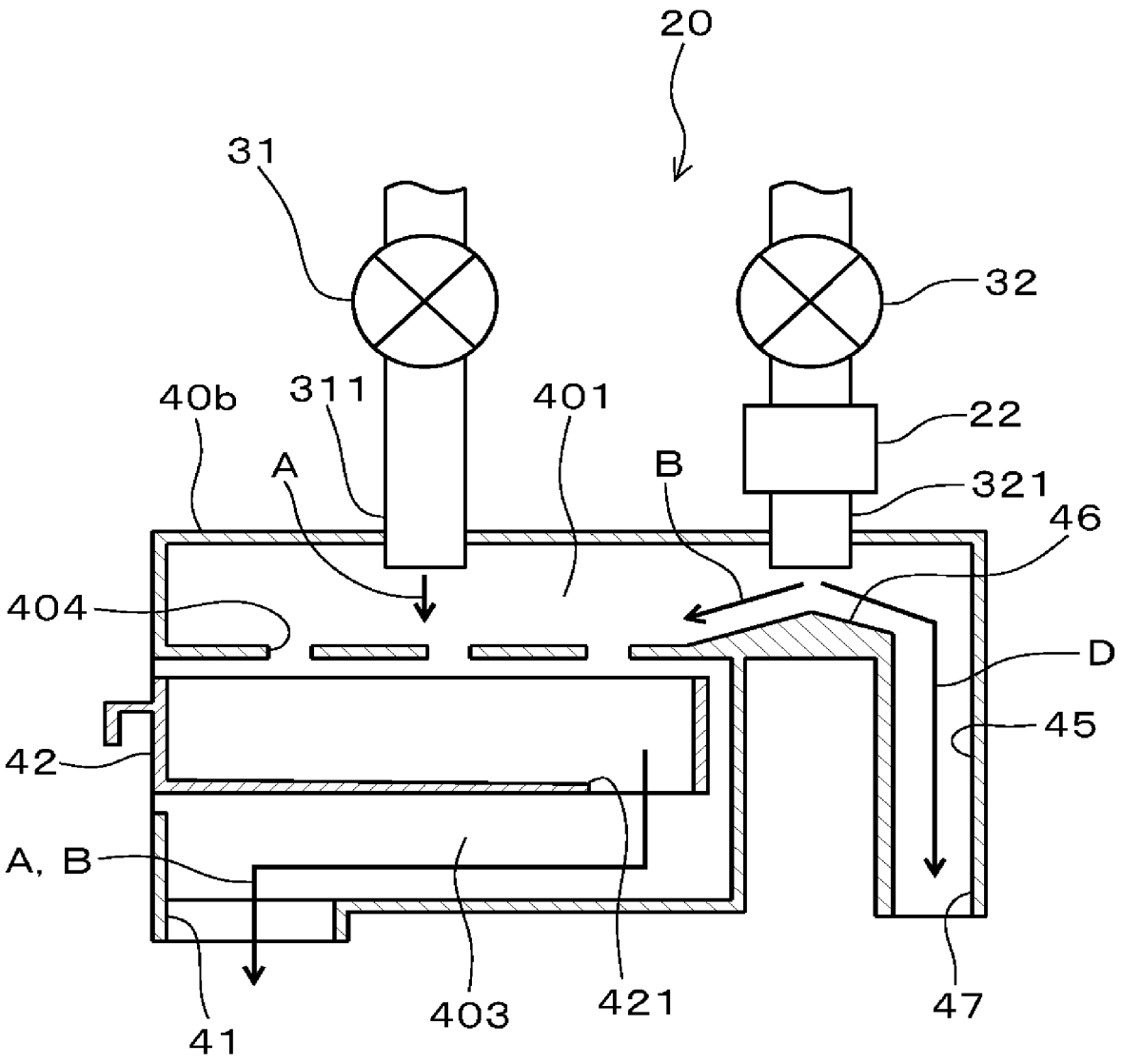
FIG. 13 is a cross sectional view schematically illustrating the structure inside a water feeding case of the washing machine according to the fifth embodiment from the side.

Next, a description will be given on a fifth embodiment with reference to FIGS. 12 and 13.

In the fifth embodiment, the structure of the water feeding case 40*b* differs from those of the above described embodiments. Elements that differ in the shape or the like from the structures of the first embodiment are identified by a reference symbol suffixed by "b".

In the present embodiment, the water feeding case 40*b* is provided with a branching tube 45, a distributing part 46, and a second water feeding port 47. As shown in FIG. 13, the branching tube 45 is configured in a tubular shape that communicates with the first upper space 401 of the water feeding case 40*b*. That is, the branching tube 45 is formed so as to branch off of the first upper space 401 of the water feeding case 40*b*.

The distributing part 46 is provided in a position corresponding to the discharging side 321 of the water supplying valve for minute bubble water 32, in this case, immediately below the discharging side 321 of the water supplying valve for minute bubble water 32. The distributing part 46 is formed for example in a mountain shape that protrudes toward the discharging side 321 of the water supplying valve for minute bubble water 32 and distributes the minute bubble water discharged from the discharging side 321 of the water supplying valve for minute bubble water 32 into the first communicating hole 404 side and the branching tube 45 side. The second water feeding port 47 is configured as an end of the branching tube 45 in the water tub 13 side and is located above the water tub 13 and the rotary tub 14 so as to open toward the inner side of the water tub 13 and the rotary tub 14.

The path extending from the connecting port 21 and through the water supplying valve for minute bubble water 32, the minute bubble generator 22, and the branching tube 45 to reach into the water tub 13 and the rotary tub 14 from the second water feeding port 47 is defined as a minute bubble water branching path D. That is, the minute bubble water branching path D is a path which is branched in the downstream side of the water supplying valve for minute bubble water 32 and the minute bubble generator 22 in the minute bubble water path B, in this case, in the first upper space 401 of the water feeding case 40*b* and extends through the branching tube 45 to reach the interior of rotary tub 13 and the rotary tub 14 from the second water feeding port 47.

The minute bubble water branching path D is a path that reaches the water tub 13 and the rotary tub 14 without passing through the detergent storing part 42.

According to the above described structure, the minute bubble water passing through the minute bubble water branching path D is discharged toward the water tub 13 and the rotary tub 14 also from the second water feeding port 47 which is a water feeding port different from the first water feeding port 41. That is, only the minute bubble water is discharged from the second water feeding port 47. Thus, it is easy for the user to recognize that the water discharged from the second water feeding port 47 is the minute bubble water containing minute bubbles which has passed through the minute bubble generator 22. Hence, by checking the water discharged from the second water feeding port 47, the user is capable of readily recognizing that the minute bubble water is being supplied and is thereby allowed to visually understand that minute bubble water is being used in the washing operation. That is, it is possible to appeal to the user that in the washing machine 10, the water fed from the second water feeding port 47 is the minute bubble water. Further, because some of the minute bubble water is distributed by the distributing part 46 and used in the dissolving of the detergent, it is possible to obtain the above described dispersing effect of the surfactant. In doing so, by arranging the minute bubble water to fall on the detergent storing position from above, it is possible to dissolve the detergent directly and more smoothly.

Sixth Embodiment

Figure 14:
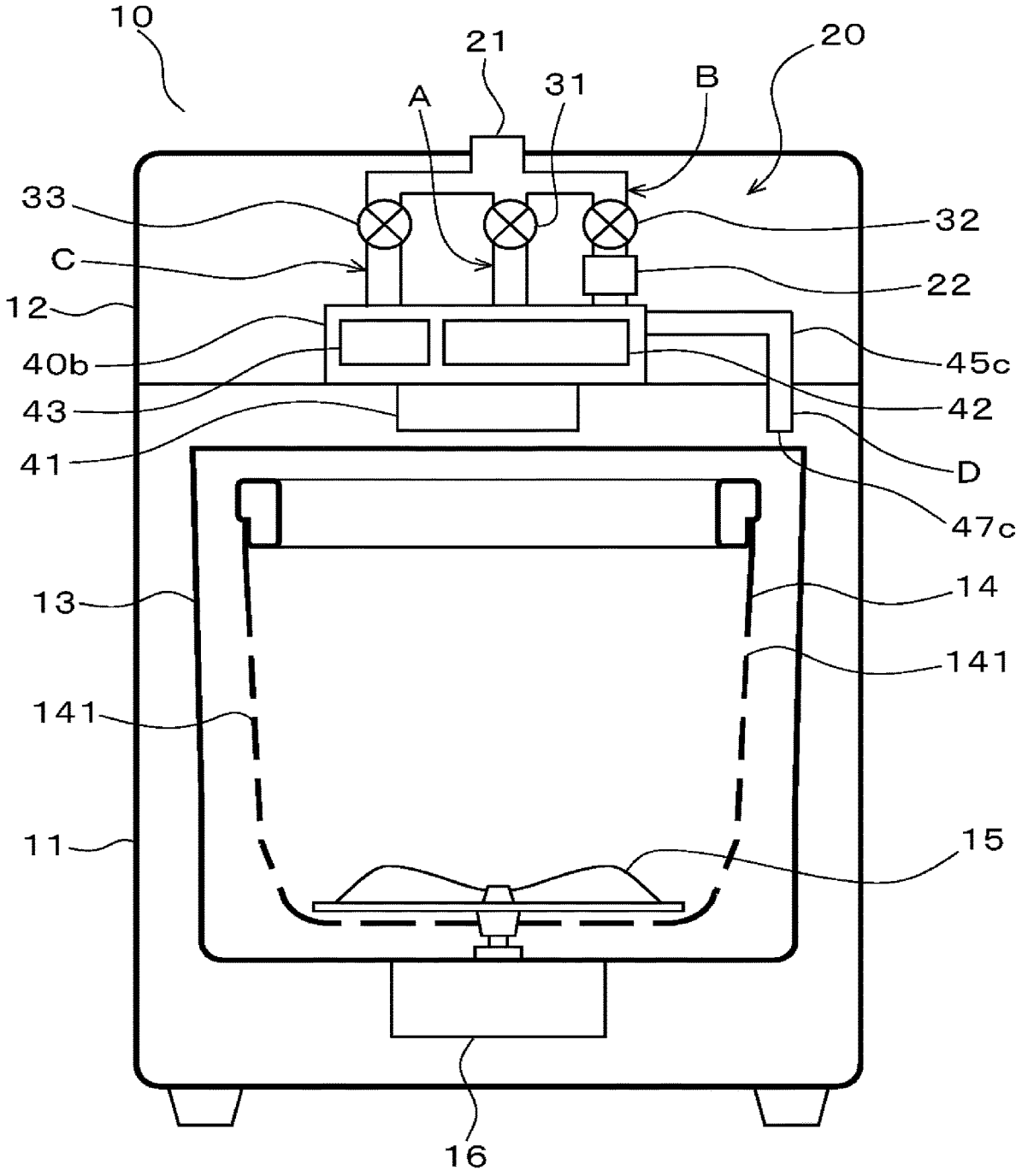
FIG. 14 is a cross sectional view schematically illustrating the structure of the washing machine according to a sixth embodiment from the front side.

Next, a description will be given on a sixth embodiment with reference to FIG. 14.

The controls performed in the pre-wash water supplying step of the step S11 indicated in FIG. 10 may employ any of the configurations of the first to the third embodiments in this embodiment as well.

In the sixth embodiment, the structures of the branching tube 45 and the second water feeding port 47 differ from those of the fifth embodiment. Elements that differ in the shape or the like from the structures of the above described embodiments are identified by a reference symbol suffixed by "c".

The branching tube 45*c* of the sixth embodiment extends to a portion between the water tub 13 and the rotary tub 14. The second water supplying port 47*c* is located above the portion between the water tub 13 and the rotary tub 14 and is configured to feed water toward the portion between the water tub 13 and the rotary tub 14. In this case, the minute bubble water passed through the branching tube 45*c*, that is, the minute bubble water passed through the minute bubble water branching path D is fed between the water tub 13 and the rotary tub 14 from the second water feeding port 47*c*.

The minute bubble water discharged from the second water feeding port 47*c* is stored in the water tub 13 after contacting the inner surface of the water tub 13 and the outer surface of the rotary tub 14. By causing the minute bubble water to contact the inner surface of the water tub 13 and the outer surface of the rotary tub 14, the inner surface of the water tub 13 and the outer surface of the rotary tub 14 can be cleaned by the cleaning effect of the minute bubble water.

The minute bubbles in the minute bubble water are prone to vanish when hitting soft materials such as clothes. Thus, in case the washing machine 10 is a type in which detergent is supplied directly to the bottom of the rotary tub 14 for example, when minute bubble water is fed from above the clothes stored in the rotary tub 14, the minute bubbles in the minute bubble water are prone to vanish before the minute bubble water reaches the detergent and thus, may prevent the effect of the minute bubble water from being exerted sufficiently.

In the present embodiment on the other hand, the minute bubble water passed through the minute bubble water branching path D is fed between the water tub 13 and the rotary tub 14 from the second water feeding port 47*c*. Thus, the minute bubble water fed into the water tub 13 is capable of contacting the detergent supplied to the bottom of the rotary tub 14 before contacting the clothes stored in the rotary tub 14. Thus, even in case the washing machine 10 is a type in which detergent is supplied to the bottom portion of the rotary tub 14, it is possible to sufficiently cause interaction between the above described surfactant in the detergent and the minute bubbles in the minute bubble water.

Seventh Embodiment

Figure 15:
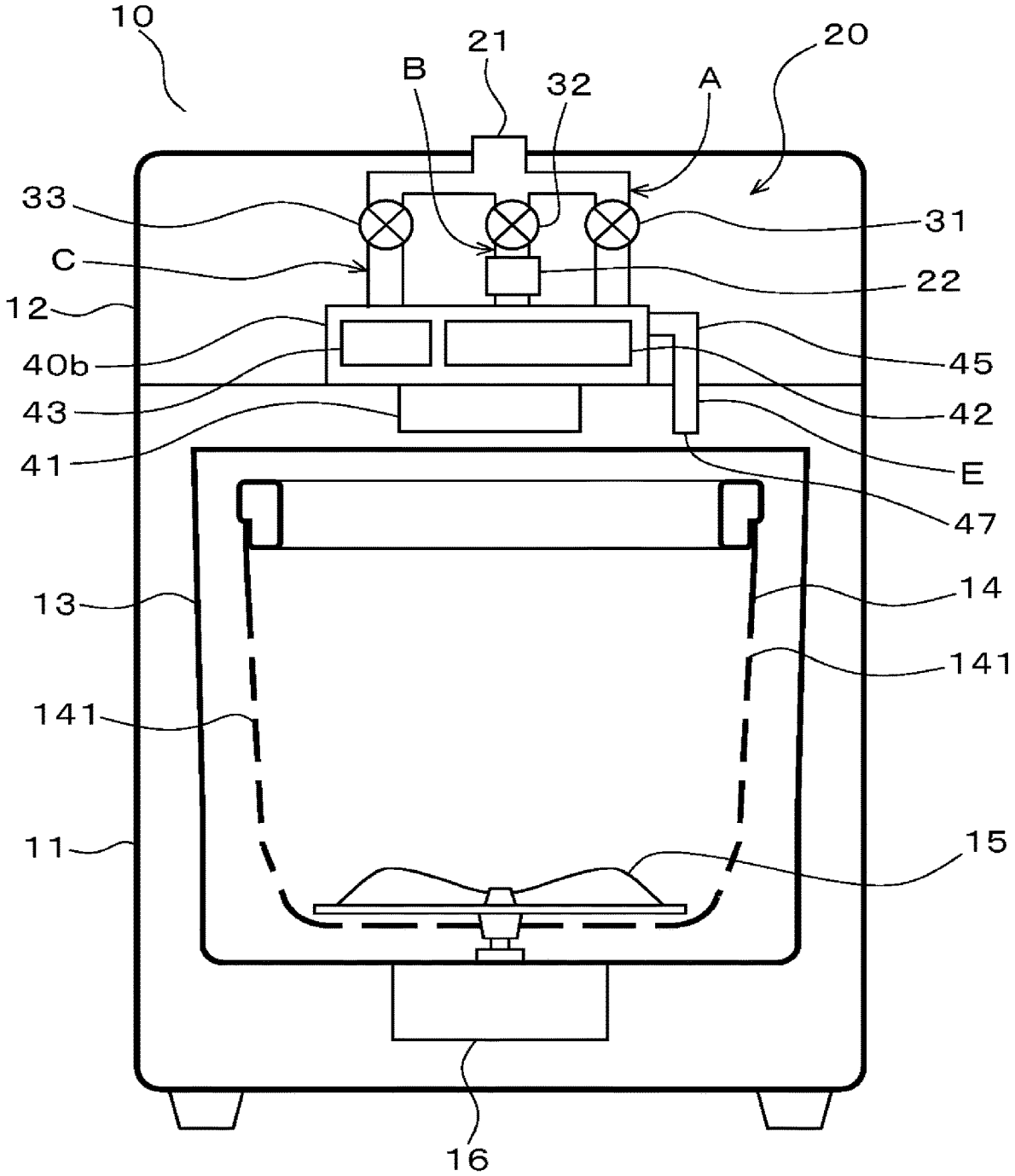
FIG. 15 is a cross sectional view schematically illustrating the structure of the washing machine according to a seventh embodiment from the front side.
Figure 16:
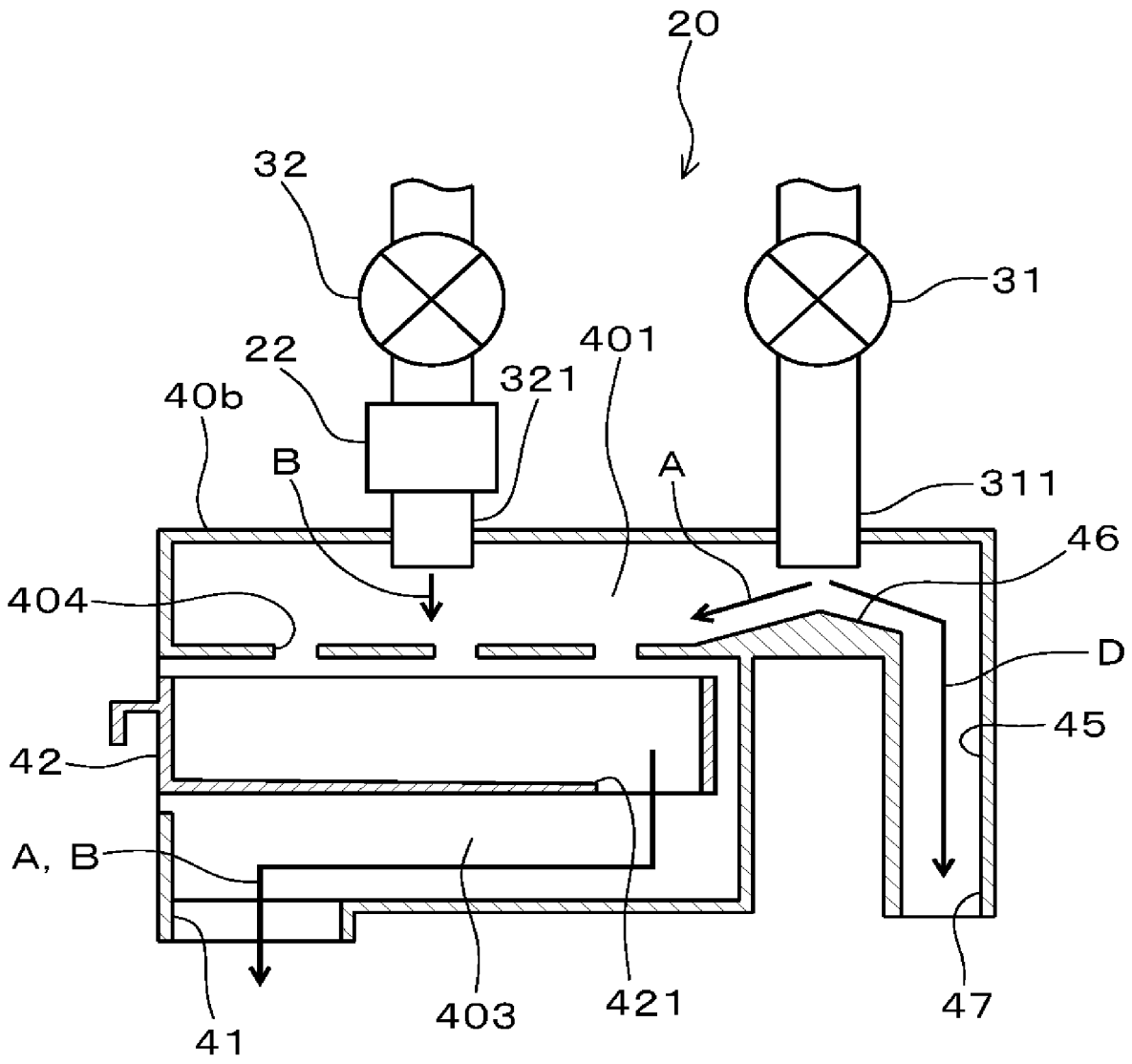
FIG. 16 is a cross sectional view schematically illustrating the structure inside a water feeding case of the washing machine according to the seventh embodiment from the side.

Next, a description will be given on a seventh embodiment with reference to FIGS. 15 and 16.

The controls performed in the pre-wash water supplying step of step S11 indicated in FIG. 10 may employ any of the configurations of the first to the third embodiments in this embodiment as well.

The seventh embodiment differs from the fifth embodiment in the mode of connection of the discharging side 311 of the water supplying valve for tap water 31 and the discharging side 321 of the water supplying valve for minute bubble water 32 with respect to the water feeding case 40*b*. That is, in the present embodiment, the connecting position of the discharging side 311 of the water supplying valve for tap water 31 and the connecting position of the discharging side 321 of the water supplying valve for minute bubble water 32 with respect to the water feeding case 40*b* are configured to be the opposite of the fifth embodiment.

More specifically, the discharging side 321 of the water supplying valve for minute bubble water 32 is connected to the position corresponding to the first communicating holes 404, for example, the portion above the first communicating holes 404 in the first upper space 401 of the water feeding case 40*b*. On the other hand, the discharging side 311 of the water supplying valve for tap water 31 is provided at the position corresponding to the distributing part 46, for example, the portion immediately above the distributing part 46 in the first upper space 401 of the water feeding case 40*b*. In this case, the distributing part 46 distributes the tap water discharged from the discharging side 311 of the water supplying valve for tap water 31 to the first communicating hole 404 side and to the branching tube 45 side.

In this configuration, the path extending from the connecting port 21 to the water tub 13 and the rotary tub 14 through the water supplying valve for tap water 31, the branching tube 45 and the second water feeding port 47 is defined as a tap water branching path E. That is, the tap water branching path E is a path that is branched in the downstream side of the water supplying valve for tap water 31 in the tap water path A, in this case, in the first upper space 401 of the water feeding case 40*b* and reaches the interior of the water tub 13 and the rotary tub 14 through the branching tube 45 and the second water feeding port 47. The tap water branching path E is a path reaching the interior of the water tub 13 and the rotary tub 14 without passing through the minute bubble generator 22 and the detergent storing part 42.

The above described configuration also provides the operation and effect similar to those of the foregoing embodiments. Further, all of the minute bubble water passing through the minute bubble water path B can be used to dissolve the detergent stored in the detergent storing part 42 and thus, the above described dispersing effect of the surfactant can be obtained effectively and sufficiently.

The minute bubble water passing through the minute bubble water path B is subjected to water flow resistance at the minute bubble generator 22 and thus, the amount of water flowing therethrough is small. Hence, when only the minute bubble water is used to dissolve the detergent in the detergent storing part 42, the detergent tends to remain in the detergent storing part 42 when dissolved only by the amount of water passing through the detergent storing part 42. In the present embodiment on the other hand, because some of the water from the tap water capable of supplying sufficient amount of water is distributed by the distributing part 46 and contributes in the dissolving and discharging of the detergent, it is possible to expect the effect of preventing the detergent from remaining in the detergent storing part 42. Further, because only some of the tap water discharged from the discharging side 311 of the water supplying valve for tap water 31 is distributed, the detergent storing part 42 can be designed to allow only a small volume of water to flow therethrough and is also capable of inhibiting splashing of the tap water.

Eighth Embodiment

Figure 17:
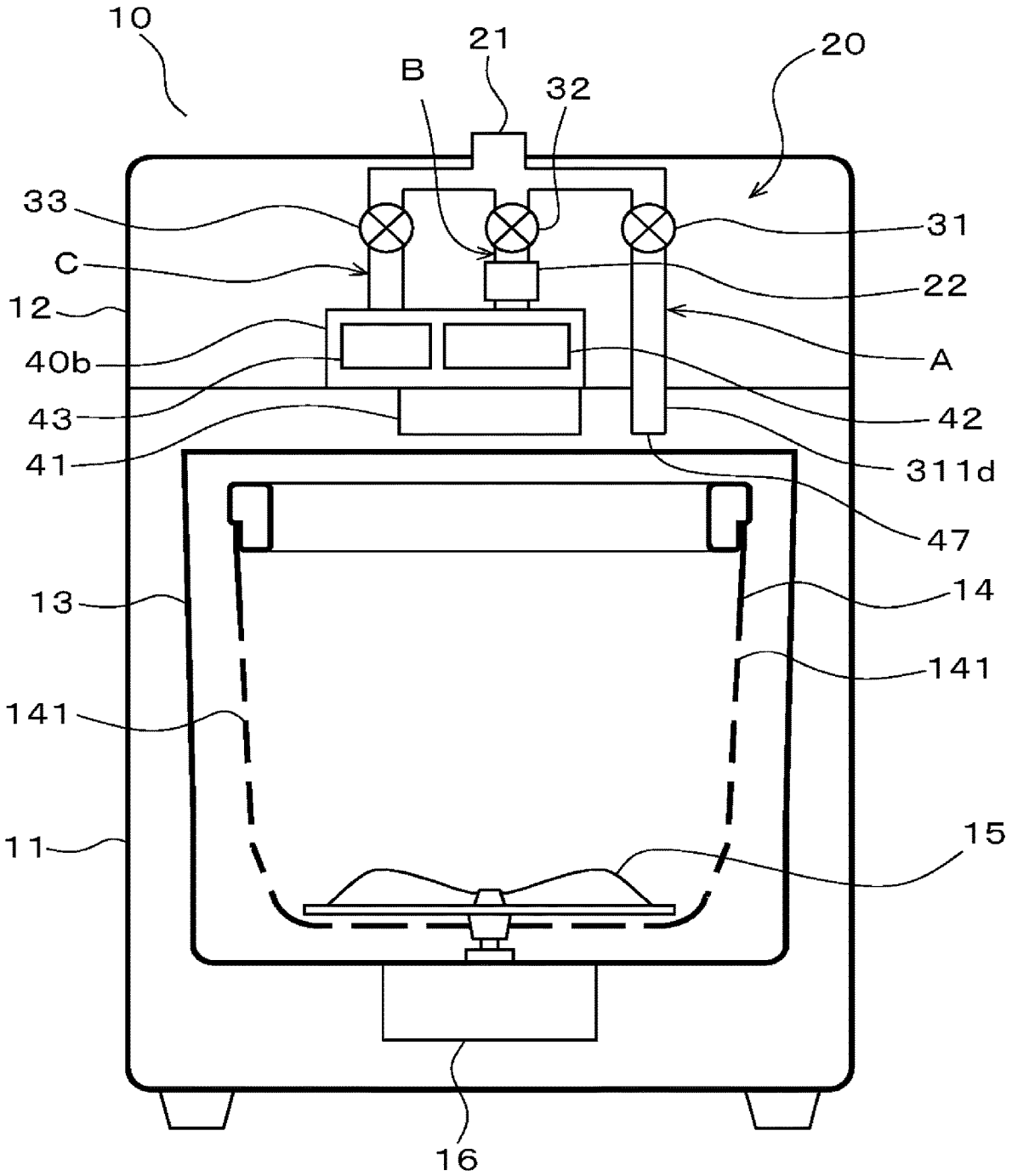
FIG. 17 is a cross sectional view schematically illustrating the structure of the washing machine according to an eighth embodiment from the front side.

Next, a description will be given on an eighth embodiment with reference to FIG. 17. The controls performed in the pre-wash water supplying step of step S11 indicated in FIG. 10 may employ any of the configurations of the first to the third embodiments in this embodiment as well.

In the present embodiment, elements that differ in the shape or the like from the structures of the above described embodiments are identified by a reference symbol suffixed by "d".

The eighth embodiment differs from the foregoing embodiments in that a discharging side 311*d* of the water supplying valve for tap water 31 is configured to feed water directly to the water tub 13 and the rotary tub 14 without being connected to the case 40.

That is, in the present embodiment, the tip of the discharging side 311*d* of the water supplying valve for tap water 31 constitutes the second water feeding port 47. In the present embodiment, the tap water path A is a path extending from the connecting port 21 and reaching the water tub 13 and the rotary tub 14 through the water supplying valve for tap water 31 and the second water feeding port 47. In this case, the tap water path A passes the outside of the case 40 and thus, does not merge with the minute bubble water path B in the water feeding case 40. The water passing through the tap water path A is fed into the water tub 13 and the rotary tub 14 by being discharged from the second water feeding port 47 which is different from the first water feeding port 41.

According to the above described configuration, the three paths A, B, and C dividing off at the downstream side of the connecting port 21 simply feed water into the water tub 13 and the rotary tub 14 from their respective destinations and are thus, formed in the simplest configuration. Thus, the paths are formed at low cost while obtaining the operation and effect similar to those of the foregoing embodiments.

Further, the tap water path A and the minute bubble water path B are paths that do not merge with one another. That is, the second water feeding port 47 serving as the exit of the tap water path A and the first water feeding port 41 serving as the exit of the minute bubble water path B are different. Thus, it is possible for the user to easily recognize that the water discharged from the first water feeding port 41 has passed through the minute bubble generator 22 and is the minute bubble water containing minute bubbles. Thus, it is possible for the user to easily recognize that the water discharged from the first water feeding port 41 is the minute bubble water and as a result, visually understand that the minute bubble water is being used in the washing operation. That is, the washing machine 10 is capable of appealing to the user that the water fed from the first feeding port 41 is the minute bubble water.

Ninth Embodiment

Figure 18:
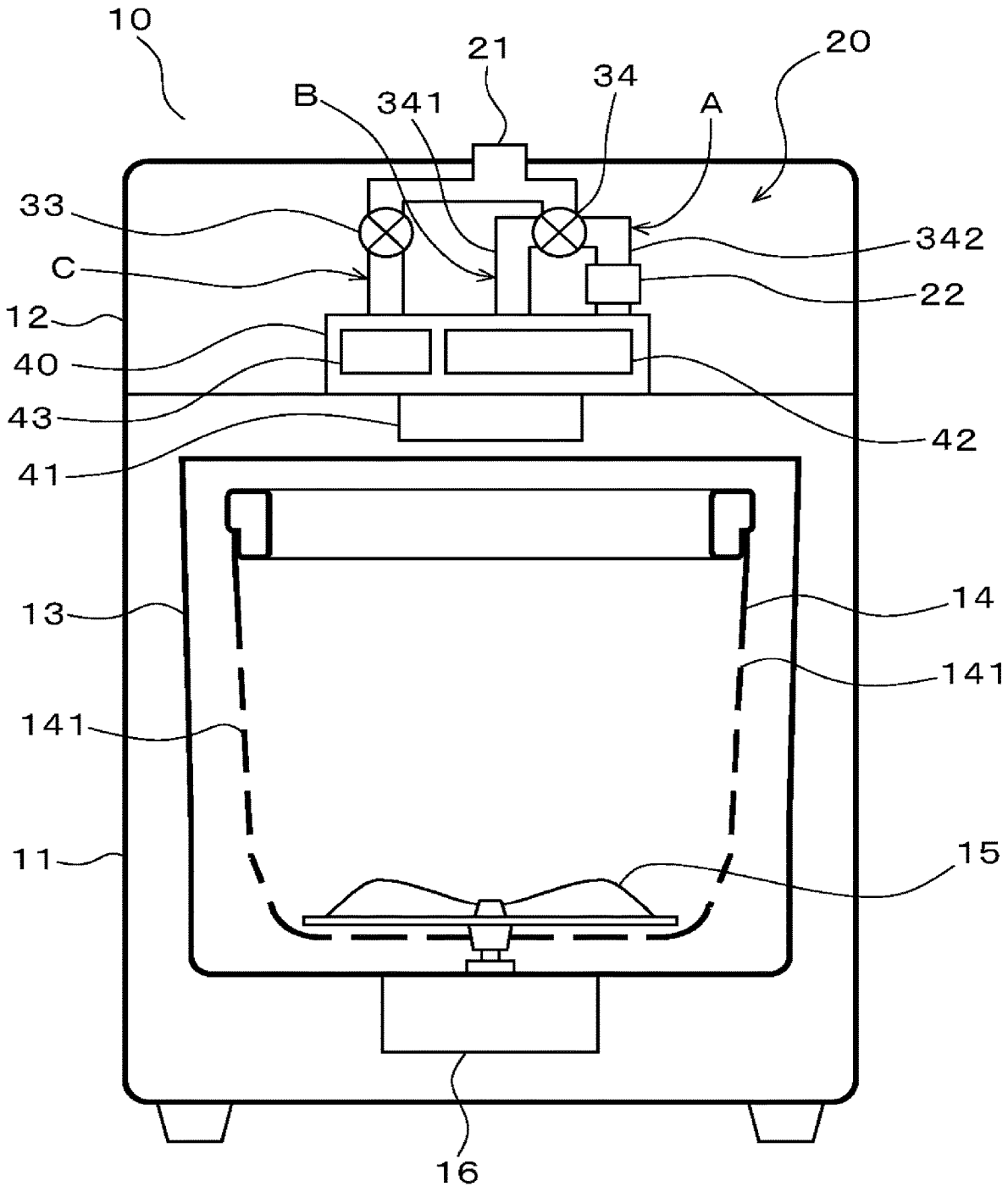
FIG. 18 is a cross sectional view schematically illustrating the structure of the washing machine according to a ninth embodiment from the front side.
Figure 19:
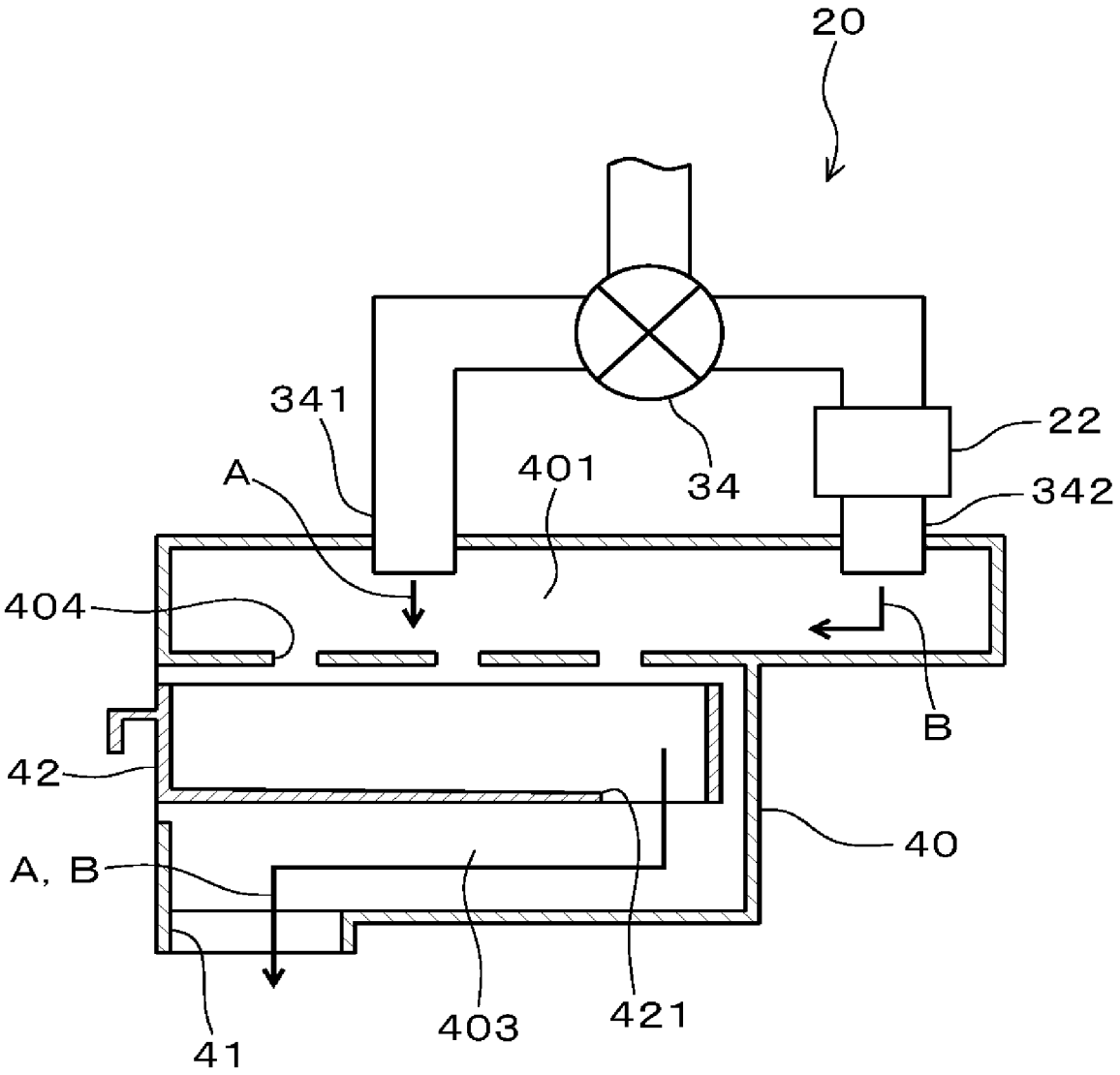
FIG. 19 is a cross sectional view schematically illustrating the structure inside a water feeding case according to the ninth embodiment from the side.

Next, a description is given on a ninth embodiment with reference to FIGS. 18 and 19.

In the present embodiment, the controls performed in the pre-wash water supplying step of step S11 indicated in FIG. 10 may employ either of the configurations of the first and the second embodiment.

The ninth embodiment differs from the foregoing embodiments in that the water supplying valve for tap water 31 and the water supplying valve for minute bubble water 32 are configured by a single three way valve 34.

In the present embodiment, the water feeding device 20 is provided with the three way valve 34. The three way valve 34 is connected to the connecting port 21. The three way valve 34 is configured so as to be capable of switching between a state in which a first discharging side 341 is opened, a state in which a second discharging side 342 is opened, and a state in which both the first discharging side 341 and the second discharging side 342 are closed. The first discharging side 341 is not provided with the minute bubble generator 22 but the second discharging side 342 is provided with the minute bubble generator 22.

In this case, the tap water path A is a path that passes through the first discharging side 341 of the three way valve 34 from the connecting port 21 and is discharged from the first water feeding port 41 of the water feeding case 40 without passing through the minute bubble generator 22. Further, the minute bubble water path B is a path passing through the second discharging side 342 of the three way valve 34 and the minute bubble generating device 22 from the connecting port 21 and is discharged from the first water feeding port 41 of the water feeding case 40. In this case, the first upper space 401 which has not yet passed through the detergent storing part 42 serves as the common path of the tap water path A and the minute bubble water path B.

According to the above described configuration, operation and effects similar to those of the first embodiment can be obtained.

Further according to the present embodiment, because the water supplying valve for tap water 31 and the water supplying valve for minute bubble water 32 of the first embodiment are configured by a single three way valve 34, it is possible to reduce the number of parts used in the water feeding device 20 and thereby reduce the cost of parts and reduce the man-hours required in assembling the parts.

Tenth Embodiment

Figure 20:
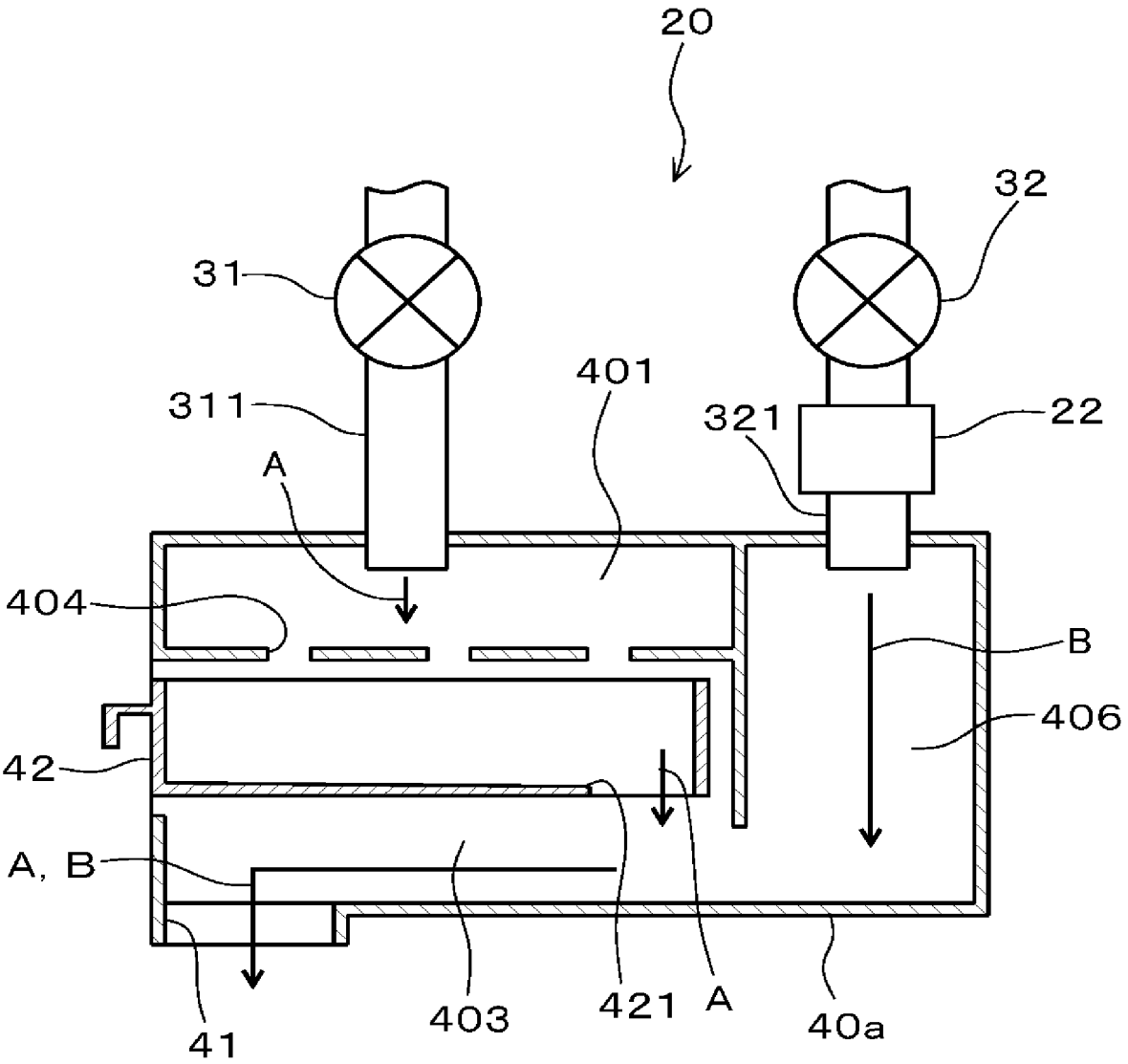
FIG. 20 is a cross sectional view schematically illustrating the structure inside a water feeding case of the washing machine according to a tenth embodiment from the side.

Next, a description will be given on a tenth embodiment with reference to FIGS. 20 and 21.

Figure 11:
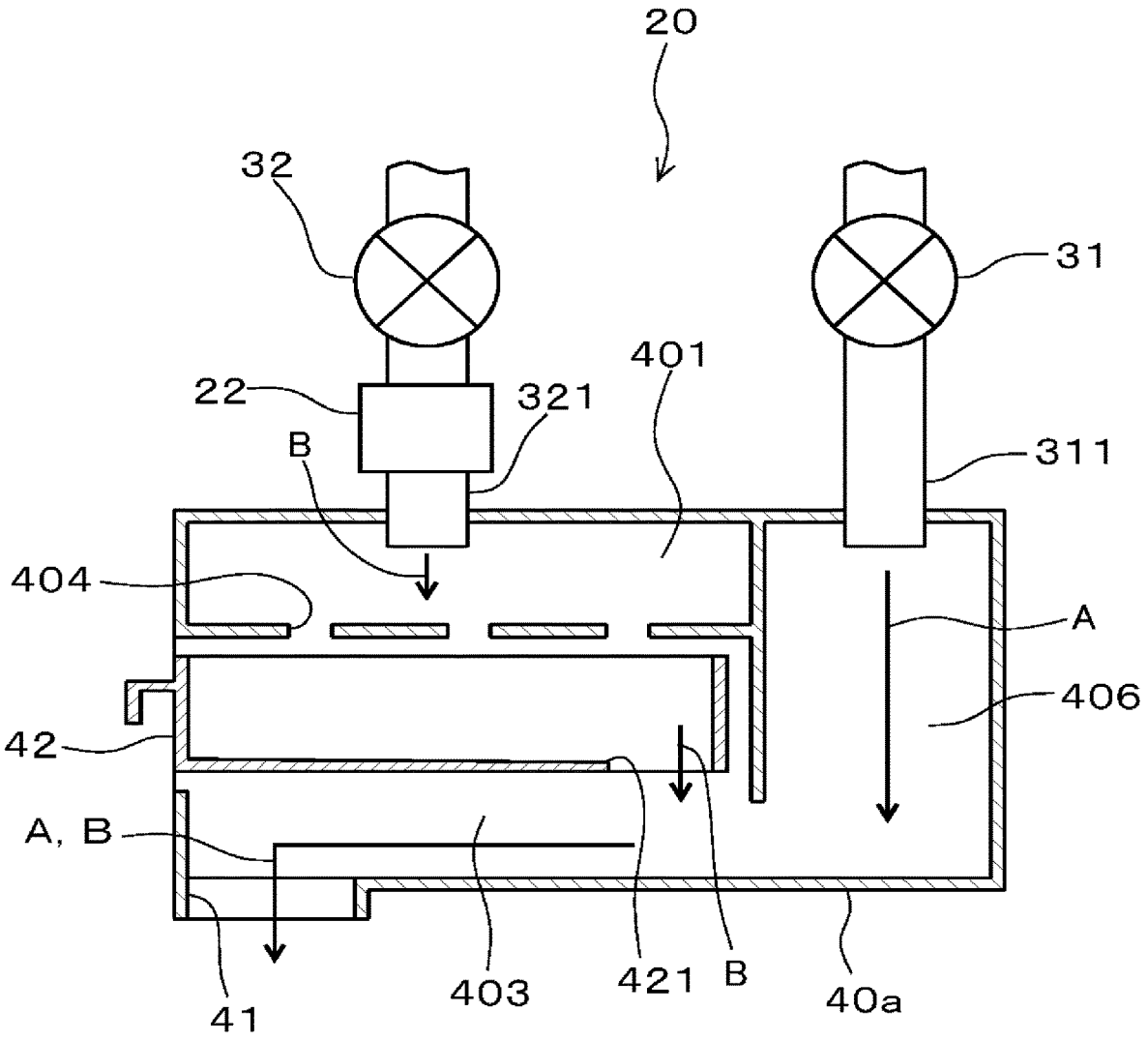
FIG. 11 is a cross sectional view schematically illustrating the structure inside a water feeding case of the washing machine according to a fourth embodiment from the side.

In the tenth embodiment, the positions of the discharging side 311 of the water supplying valve for tap water 31 and the discharging side 321 of the water supplying valve for minute bubble water 32 in FIG. 11 of the fourth embodiment are interchanged. That is, the tenth embodiment differs from the fourth embodiment of FIG. 11 in that the positions of the tap water path A and the minute bubble water path B are the opposite of those of the fourth embodiment.

That is, in the present embodiment, the discharging side 311 of the water supplying valve for tap water 31 is connected to the first upper space 401. On the other hand, the discharging side 321 of the water supplying valve for minute bubble water 32 is connected to the interior of the passing space 406 of the water feeding case 40*a* via the minute bubble generator 22. Thus, the minute bubble water path B merges with tap water path A in the water feeding case 40*a* without passing through the detergent storing part 42. In other words, the tap water path A merges with minute bubble water path B in the water feeding case 40*a* after passing through the detergent storing part 42 in the water feeding case 40*a*.

Figure 21:
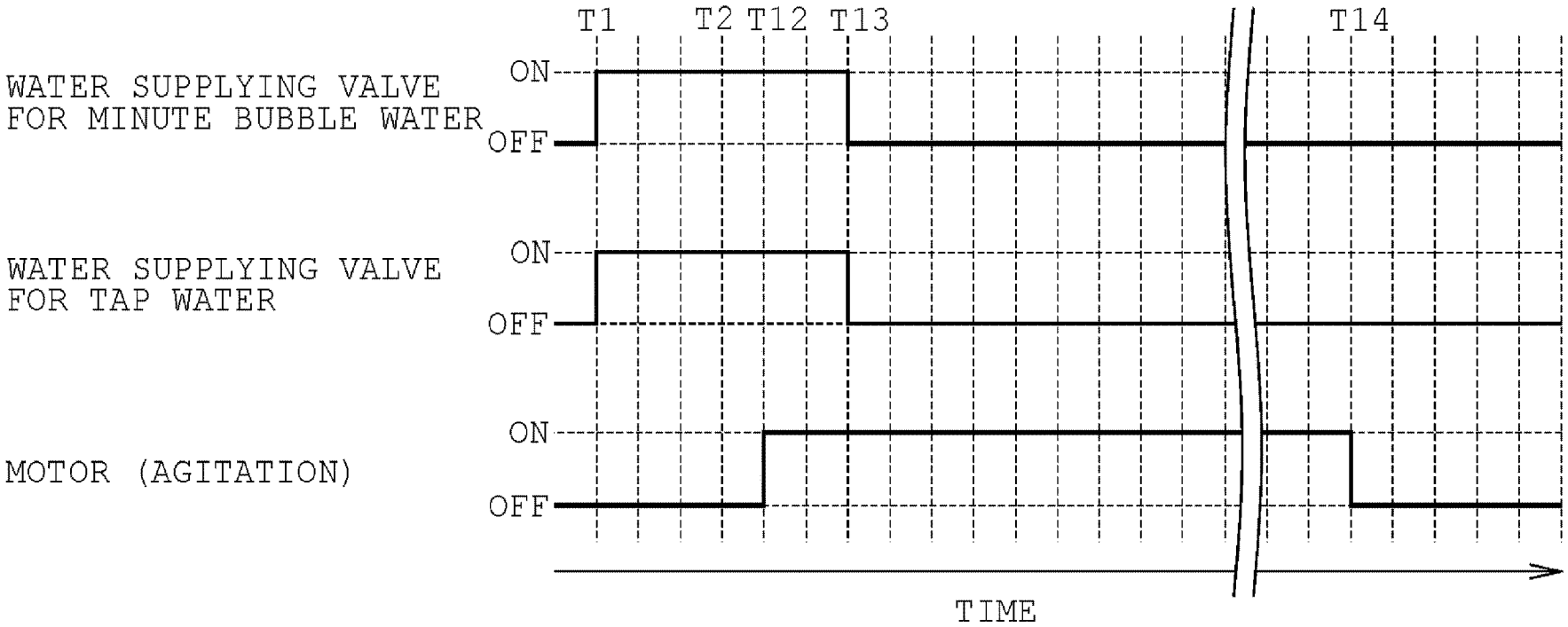
FIG. 21 is a timing chart chronologically indicating the operation of each component in the pre-wash water supplying step and the wash step of the washing machine according to the tenth embodiment.

The control device 17, when executing the pre-wash water supplying step of step S11 in the washing operation indicated in FIG. 7, opens both the water supplying valve for tap water 31 and the water supplying valve for minute bubble water 32 at time T1 as indicated in FIG. 21. That is, in the present embodiment, both the water supplying valve for tap water 31 and the water supplying valve for minute bubble water 32 are opened during the first period T1-T2 as well.

Then, the control device 17, when detecting that water has been fed to the predetermined water level inside the water tub 13, operates the motor 16 as indicated at time T12 of FIG. 21 to relatively rotate the pulsator 15 and the rotary tub 14 at low speed. Thus, as shown in FIG. 10, the wash step of step S12 is started during the pre-wash water supplying step of step S11. In this case, the water level inside the water tub 13 at time T12 is substantially the same as the water level at time T3 in FIG. 8 of the first embodiment, the water level at time T6 in FIG. 9 of the second embodiment, and the water level inside the water tub 13 at time T9 in FIG. 10 of the third embodiment.

Then the control device 17, when detecting that water has fed to the set water level in the water tub 13, closes the water supplying valve for tap water 31 and the water supplying valve for minute bubble water 32 as indicated at time T13 to stop feeding of water into the water tub 13. The control device 17, continues to agitate the clothes inside the rotary tub 14 by driving the motor 16 for a predetermined period from time T12, and thereafter stops the motor 16 as indicated at time T14. Thus, the control device 17 terminates the wash step at step S12 of FIG. 7.

In this case, the entire period in which water is being fed into the water tub 13 by the water feeding device 20, that is, the time period from time T1 to time T13 is defined as the water supplying period T1-T13. In the present embodiment, both the water supplying valve for tap water 31 and the water supplying valve for minute bubble water 32 are opened throughout the entire period of the water supplying step. Thus, the water supplying step T1-T13 of the present embodiment is shorter than the water supplying period T1-T4 indicated in FIG. 8 of the first embodiment, the water supplying period T1-T7 indicated in FIG. 9 of the second embodiment, and the water supplying period T1-T10 indicated in FIG. 10 of the third embodiment.

According to the tenth embodiment, the detergent flown out by the tap water passing through the detergent storing part 42 is immediately placed in contact with the minute bubble water in the lower space 403 provided in the water feeding case 40*a*. This also causes interaction between the surfactant in the detergent and the minute bubbles in the minute bubble water in the wash water discharged from the first water feeding port 41 as was the case in the foregoing embodiments. Thus, the cleaning capacity can be significantly improved in the present embodiment as well compared to a simple minute bubble water or a simple wash water in which detergent is merely dissolved in the tap water. As a result, the effect of the minute bubble water can be sufficiently improved and exerted.

Further in the present embodiment, the tap water path A reaches the water tub 13 and the rotary tub 14 from the first water feeding port 41 after passing through the detergent storing part 42 of the water feeding case 40*a*. Thus, tap water flowing through the tap water path A passes through the detergent storing part 42. The amount of tap water flowing through the tap water path A is greater than the amount of minute bubble water flowing through the minute bubble water path B. Thus, the detergent in the detergent storing part 42 is dissolved and washed down by the tap water which is greater in amount compared to the minute bubble water flowing through the minute bubble water path B. Thus, it is possible to wash down the detergent inside the detergent storing part 42 more reliably and more reliably prevent the detergent from remaining in the detergent storing part 42.

Further, in the present embodiment, both the water supplying valve for tap water 31 and the water supplying valve for minute bubble water 32 are opened throughout the entire water supplying period, that is, through water supplying period T2-T13. Thus, the water supplying period T2-T13 until reaching the set water level can be made shorter compared to the water supplying period T1-T3 of the first embodiment, the water supplying period T1-T7 of the second embodiment, and the water supplying period T1-T10 of the third embodiment. That is, in the present embodiment, it is possible to terminate the water supplying step of step S11 in a shorter time period compared to the first, the second, and the third embodiments while improving the effect of the minute bubble water and consequently reduce the entire time of the washing operation, that is, the time period T1-T14.

The controls described in FIG. 21 of the present embodiment may be applied to a configuration in which water supplying valves 31 and 32 are provided independently to the tap water path A and the minute bubble water path B respectively. That is, the controls described in FIG. 21 of the present embodiment may be applied to the configuration of the first embodiment indicated in FIG. 5 and the like, the configuration of the fourth embodiment indicated in FIG. 11, the configuration of the fifth embodiment indicated in FIG. 13, the configuration of the sixth embodiment indicated in FIG. 14, the configuration of the seventh embodiment indicated in FIGS. 15 and 16, and the configuration of the eighth embodiment indicated in FIG. 17.

In the foregoing embodiments, the terms "first" and "second" have been used for convenience to distinguish elements having similar functionalities and do not represent any priority between the elements.

The foregoing embodiments are not limited to application to a vertical axis washing machine 10 but may be applied to a lateral axis washing machine or the so called drum type washing machine in which the rotational axis of the rotary tub is horizontal or rearwardly declined.

Further, the above described embodiments may be combined as required.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. A washing machine comprising:

a wash tub configured by a water tub and a rotary tub;

a connecting port connected to a water source;

a water feeding case connected to the connecting port to receive water from the water source and containing a detergent storing part in which a detergent is stored;

a first water feeding port configured to feed water flown into the water feeding case into the wash tub;

a minute bubble generator configured to generate minute bubbles in water passing therethrough, the minute bubbles having a diameter ranging from 50 nm to several hundred μm;

a minute bubble water path extending from the connecting port and reaching into the wash tub from the first water feeding port after passing through the inside of the minute bubble generator and the detergent storing part inside the water feeding case;

a tap water path extending from the connecting port to the wash tub without passing through the minute bubble generator;

a water supplying valve for tap water provided within the tap water path and between the connecting port and the water feeding case, and capable of opening and closing the tap water path; and a water supplying valve for minute bubble water provided within the minute bubble water path and between the connecting port and the water feeding case, and capable of opening and closing the minute bubble water path.

2. The washing machine according to claim 1, wherein the tap water path is path which does not pass through the detergent storing part and which merges with the minute bubble water path in the water feeding case, and wherein the minute bubble water path merges with the tap water path in the water feeding case after passing through the detergent storing part.

3. The washing machine according to claim 1, further comprising a minute bubble water branching path which is branched in a downstream side of the water supplying valve for minute bubble water and the minute bubble generator in the minute bubble water path and which reaches the wash tub without passing through the detergent storing part, and wherein the minute bubble water branching path reaches the wash tub through a second water feeding port which is different from the first water feeding port.

4. The washing machine according to claim 3, wherein the second water feeding port feeds water between the water tub and the rotary tub.

5. The washing machine according to claim 1, further comprising a tap water branching path which is branched in a downstream side of the water supplying valve for tap water in the tap water path and which reaches the wash tub without passing through the detergent storing part, and wherein the tap water branching path reaches the wash tub through a second water feeding port which is different from the first water feeding port.

6. The washing machine according to claim 1, wherein the tap water path does not merge with the minute bubble water path in the water feeding case and reaches the wash tub through a second water feeding port different from the first water feeding port.

7. The washing machine according to claim 1, wherein the water supplying valve for tap water and the water supplying valve for minute bubble water are configured by the same three way valve.

8. The washing machine according to claim 1, wherein in a water supplying step preceding a wash step, a first period is provided in which the minute bubble water containing minute bubbles is supplied to the detergent storing part through the minute bubble generator by opening the water supplying valve for minute bubble water at or before a timing in which a detergent supplied into the detergent storing part is washed down into the wash tub.

9. The washing machine according to claim 8, further comprising a second period in which water is fed to a set water level by closing the water supplying valve for minute bubble water and opening the water supplying valve for tap water after lapse of the first period in the water supplying step preceding the wash step.

10. The washing machine according to claim 8, further comprising a third period in which water is fed to a set water level by opening the water supplying valve for minute bubble water and the water supplying valve for tap water after lapse of the first period in the water supplying step preceding the wash step.

11. The washing machine according to claim 8, wherein the water supplying valve for tap water is also opened during the first period in the water supplying step preceding the wash step.

* * * * *